US007940219B2

(12) United States Patent
Soekawa et al.

(10) Patent No.: US 7,940,219 B2
(45) Date of Patent: May 10, 2011

(54) ANTENNA, METHOD OF ADJUSTING RESONANCE FREQUENCY THEREOF, AND WIRELESS COMMUNICATION DEVICE

(75) Inventors: Kouji Soekawa, Kawasaki (JP); Masaru Kanazawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 741 days.

(21) Appl. No.: 11/378,285

(22) Filed: Mar. 20, 2006

(65) Prior Publication Data

US 2007/0146213 A1 Jun. 28, 2007

(30) Foreign Application Priority Data

Dec. 28, 2005 (JP) ..... 2005-379367

(51) Int. Cl.
*H01Q 1/24* (2006.01)
*H01Q 5/01* (2006.01)

(52) U.S. Cl. ..... 343/702; 343/826

(58) Field of Classification Search ..... 343/700 MS, 343/702, 795, 846, 833, 729, 730, 826, 828, 343/829

See application file for complete search history.

(56) References Cited

U.S. PATENT DOCUMENTS

| | | | | |
|---|---|---|---|---|
| 4,968,984 | A * | 11/1990 | Katoh et al. | 343/713 |
| 5,365,246 | A * | 11/1994 | Rasinger et al. | 343/702 |
| 5,644,319 | A * | 7/1997 | Chen et al. | 343/702 |
| 6,166,694 | A | 12/2000 | Ying | |
| 6,476,769 | B1 | 11/2002 | Lehtola | |
| 6,614,400 | B2 * | 9/2003 | Egorov | 343/702 |
| 6,650,294 | B2 * | 11/2003 | Ying et al. | 343/700 MS |
| 6,657,593 | B2 | 12/2003 | Nagumo et al. | |
| 6,859,174 | B2 * | 2/2005 | Kane et al. | 343/700 MS |
| 7,026,999 | B2 | 4/2006 | Umehara et al. | |
| 7,030,833 | B2 | 4/2006 | Ohara et al. | |
| 7,119,743 | B2 | 10/2006 | Iguchi et al. | |

FOREIGN PATENT DOCUMENTS

| | | |
|---|---|---|
| JP | 2002-520935 | 7/2002 |
| JP | 2003-008326 A | 1/2003 |
| JP | 2003-078321 A | 3/2003 |
| JP | 2003-124730 | 4/2003 |
| JP | 2004-129062 A | 4/2004 |
| JP | 2004-201278 A | 7/2004 |
| JP | 2005-094198 A | 4/2005 |
| WO | WO 00/03452 A1 | 1/2000 |
| WO | WO-2004/109857 A1 | 12/2004 |

OTHER PUBLICATIONS

"Japanese Office Action", mailed Aug. 10, 2010 by Japanese Patent Office corresponding to JP 2005-379367, with English translation. K, Oh et al., "A Dual-Band Inverted-L-Folded-Antenna with a Parasitic Wire", 2004 IEEE Antennas and Propagation Society International Symposium Digest, vol. 3, Jun. 2004, pp. 3131-3134.

Yong-Xin, Guo et al., "A Quarter-Wave U-Shaped Patch Antenna With Two Unequal Arms for Wideband and Dual-Frequency Operation", IEEE Transactions on Antennas and Propagation, Aug. 2002, vol. 50, No. 8, pp. 1082-1087.

* cited by examiner

*Primary Examiner* — Michael C Wimer

(74) *Attorney, Agent, or Firm* — Fujitsu Patent Center

(57) ABSTRACT

An antenna adaptable to a plurality of frequencies is comprised of a first element that is connected to a feeding point (feeding portion) for operation and a second element that is connected to a grounding point (grounding portion) in proximity to the first element to be operated by coupling feeding with the first element and is configured to be operated at either or both of a first frequency and a second frequency higher than the first frequency.

10 Claims, 34 Drawing Sheets

ANTENNA, METHOD OF ADJUSTING RESONANCE FREQUENCY THEREOF, AND WIRELESS COMMUNICATION DEVICE

CROSS-REFERENCE TO RELATED APPLICATIONS

This application is based upon and claims the benefit of priority from the prior Japanese Patent Application No. 2005-379367, filed on Dec. 28, 2005, the entire contents of which are incorporated herein by reference.

BACKGROUND OF THE INVENTION

1. Field of the Invention

The present invention relates to an antenna structure preferred for a wireless communication device such as a cellular phone with a plurality of frequencies for transmission/reception, as well as to an antenna adaptable to a plurality of frequencies, a method of adjusting resonance frequency thereof, and a wires communication device.

2. Description of the Related Art

Antennas used for wireless communication such as cellular phones increasingly use a multi-band, such as a dual-band or triple-band, having a communication band made up of a plurality of frequencies. To avoid installing an antenna for each band in a communication device, it is necessary to have a multi-band function that supports a plurality of frequencies with one antenna, and since compactness and design of the device are deteriorated by projecting an antenna, it is requested to incorporate the antenna within a housing.

The multi-band antennas include a dual-band inverted F antenna with an element for each different target frequency (National Publication of Translated Version No. 2002-520935 (paragraph No. 0021, FIG. 3, FIG. 4, etc.)) and an antenna using two inverted F antennas to support a triple-band or more (Japanese Patent Application Laid-Open Publication No. 2003-124730 (paragraph No. 0016, FIG. 1, FIG. 2, etc.)). National Publication of Translated Version No. 2002-520935 discloses that load resistance is inserted to make an antenna broadband, and Japanese Patent Application Laid-Open Publication No. 2003-124730 discloses that an antenna is short-circuited to a substrate GND by a switching device.

By the way, with respect to an antenna structure used with a cellular phone, for example, a multi-band compatible antenna 2 shown in FIGS. 1 and 2 is a monopole antenna, including an element 4 corresponding to a target frequency f1 and an element 6 corresponding to a target frequency f2 (>f1), and is installed on a circuit substrate 10 of a cellular phone 8. Such an antenna 2 has a VSWR (Voltage Standing Wave Ratio) characteristic shown in FIG. 3 and has VSWR=3 or less at the target frequency f1 (e.g., 80 [MHz] band) and the target frequency f2 (e.g., 2 [GHz] band). Therefore, the antenna 2 realizes a structure that exposes portions of the elements 4, 6 outside of the housing (semi-built-in structure) and a multi-band compatibility by folding the elements 4, 6 into an L-shape.

However, when attempting to completely house the antenna 2 constituted by such a monopole antenna within the housing, characteristic degradation is caused, the element 6 for the target frequency f2 is interfered by the element 4, and the target frequency f2 is prevented from supporting a broadband. Therefore, such an antenna 2 is not suitable to be housed in the housing completely and is not suitable for expanding the target frequency f2 (e.g., 1.7 [GHz] band).

When a planar inverted F antenna (PIFA) is used for the purpose of completely housing the antenna within an antenna-mounted device, a dual-band inverted F antenna may be constituted which has elements for a target frequency f1 and a target frequency f2 (National Publication of Translated Version No. 2002-520935). In general, an inverted F antenna has a narrow band and causes no problem in practical use if the bandwidth is on the order of 150 [MHz] in 2.4 [GHz] band, however, problems are posed in practical use if the bandwidth is expanded. If load resistance is inserted to support a broadband, the resistance consumes electric power and the radiation efficiency of the antenna is reduced.

When a triple-band or more is supported with the use of two inverted F antennas and a switching device is provided for short-circuiting each antenna to the substrate GND (Japanese Patent Application Laid-Open Publication No. 2003-124730), costs are increased by providing the switching device although a plurality of frequency can be supported.

National Publication of Translated Version No. 2002-520935 and Japanese Patent Application Laid-Open Publication No. 2003-124730 do not indicate or disclose such problems and do not have a configuration or idea for solving the problems.

SUMMARY OF THE INVENTION

Thus, an object of the present invention relates to an antenna adaptable to a plurality of frequencies and is to prevent characteristic deterioration due to being housed in a device.

Another object of the present invention relates to an antenna adaptable to a plurality of frequencies and is to make a high-order frequency broadband.

In order to achieve the above objects, according to a first aspect of the present invention there is provided an antenna adaptable to a plurality of frequencies, comprising a first element that is connected to a feeding point for operation; and a second element that is connected to a grounding point, the second element being in proximity to the first element, the second element being operated by coupling feeding with the first element, wherein the antenna is operated at either or both of a first frequency and a second frequency higher than the first frequency.

In such a configuration, the first element on the feeding side and the second element on the ground side are closely located and operated by the coupling feeding. When the first element is resonated by the second frequency and the second element is resonated by the first frequency, since the high-order resonance frequency of the second element is affected by coupling with the first element, the first frequency is reduced and the second frequency can be made broadband. This antenna acts as an inverted F antenna at the first frequency and operates in the same way as a dipole antenna at the second frequency. Therefore, if the antenna is mounted to a wireless communication device such as a cellular phone, a characteristic can be obtained which is less affected by a human body.

To achieve the above objects, in the above antenna, the first element may be set to a length resonated by the second frequency, and the second element may have a length resonated by the first frequency and have a high-order resonance frequency set in the vicinity of the second frequency. According to such a configuration, because of the coupling feeding due to the proximity of the first and second elements, the resonance frequency of the first element is reduced; the primary frequency of the second element is also reduced and is set to the first frequency; and the high-order resonance frequency of the second element is adjusted to the second frequency.

To achieve the above objects, the antenna may be configured such that: the first element and the second element operate as a dipole antenna at the second frequency; the first element and the second element are arranged in three-dimension; the second element includes a turn-back portion and the high-order resonance frequency is adjusted by the turn-back portion; and the first element and the second element are installed within the housing of the wireless communication device.

In order to achieve the above objects, according to a second aspect of the present invention there is provided a method of adjusting resonance frequency of an antenna adaptable to a plurality of frequencies, wherein a turn-back portion is formed in a second element for coupling feeding with a first element connected to a feeding point so that high-order resonance frequency is adjusted by the position of the turn-back portion. According to such a configuration, since the second element includes the turn-back portion, the high-order resonance frequency can be adjusted by the position of the turn-back portion.

In the above method of adjusting resonance frequency of an antenna, the second element may have a length resonated by a first frequency, the high-order resonance frequency may be adjusted to a second frequency higher than the first frequency or in the vicinity of the second frequency, and the first element may be adjusted to a length resonated by the second frequency. According to such a configuration, the second frequency can be adjusted to a desired frequency.

In order to achieve the above objects, according to a third aspect of the present invention there is provided a wireless communication device housing an antenna adaptable to a plurality of frequencies, the device comprising a first element that is connected to a feeding point for operation; and a second element that is connected to a grounding point, the second element being in proximity to the first element, the second element being operated by coupling feeding with the first element, wherein the wireless communication device is operated at either or both of a first frequency and a second frequency higher than the first frequency. As already described, according to the antenna with such a configuration, the antenna acts as an inverted F antenna at the first frequency and operates in the same way as a dipole antenna at the second frequency. In the wireless communication device such as a cellular phone equipped with the antenna, the antenna is completely housed within the housing; the second frequency is made broadband without characteristic deterioration such as reduction of the radiation efficiency of the antenna; and a characteristic can be obtained which is less affected by a human body. Therefore, the antenna can be completely housed within the housing to obtain a wireless communication device with the good radiation efficiency.

To achieve the above objects, the wireless communication device may be configured such that: the first element has a length resonated by the second frequency and the second element has a length resonated by the first frequency as well as the high-order resonance frequency is set in the vicinity of the second frequency; the first element and the second element operate as a dipole antenna at the second frequency; the first element and the second element are arranged in three-dimension; and the second element includes a turn-back portion and the high-order resonance frequency is adjusted by the turn-back portion.

The technical features and advantages of the present invention are as follows.

(1) A practical multi-band antenna can be obtained without impairing an antenna function even when the antenna is housed within a device.

(2) A high-order frequency can be made broadband.

Other objects, features, and advantages of the present invention will become apparent with reference to the accompanying drawings and embodiments.

DETAILED DESCRIPTION OF THE PREFERRED EMBODIMENTS

First Embodiment

Figure 1:
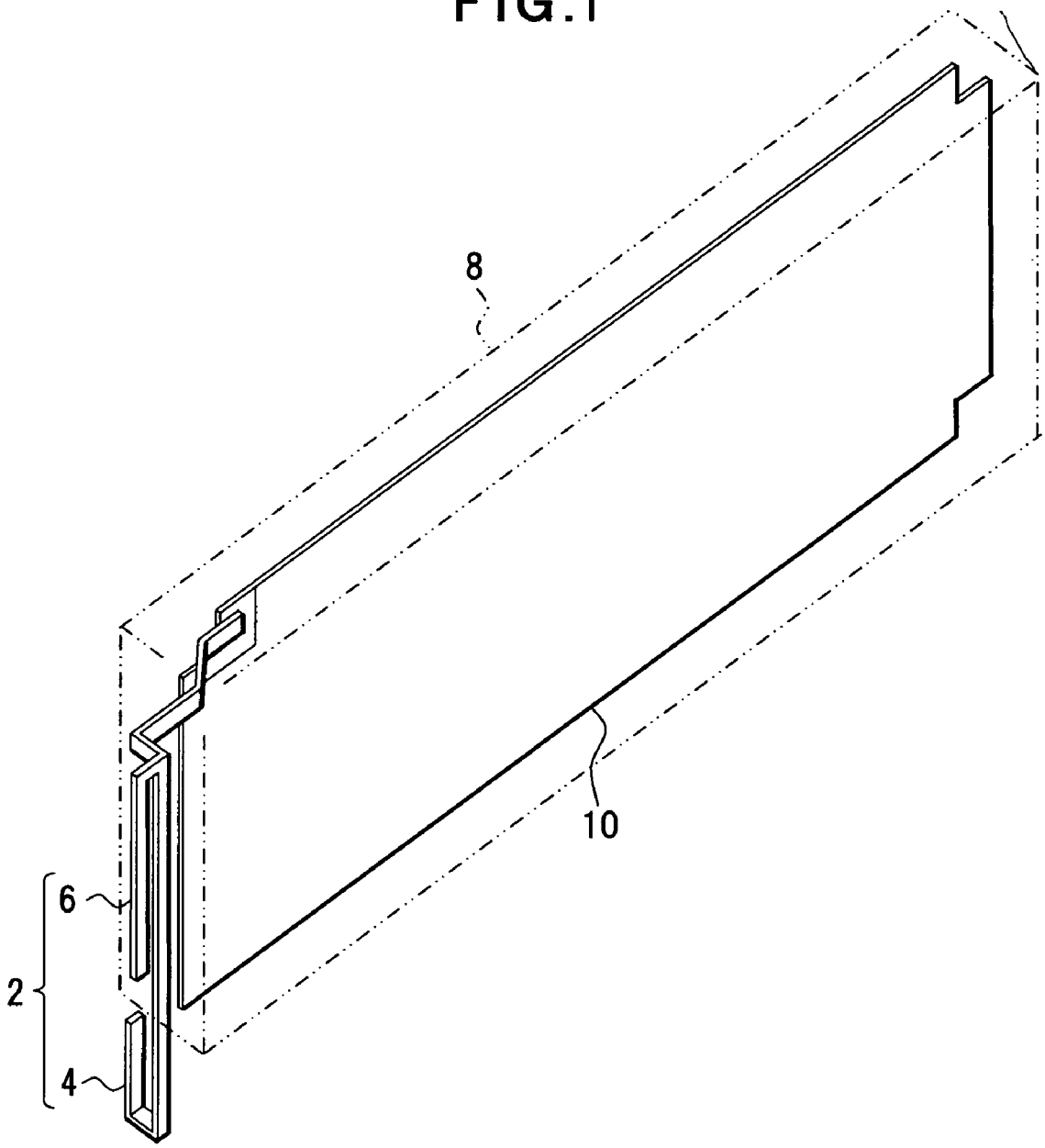
FIG. 1 shows an antenna structure of a cellular phone.
Figure 2:
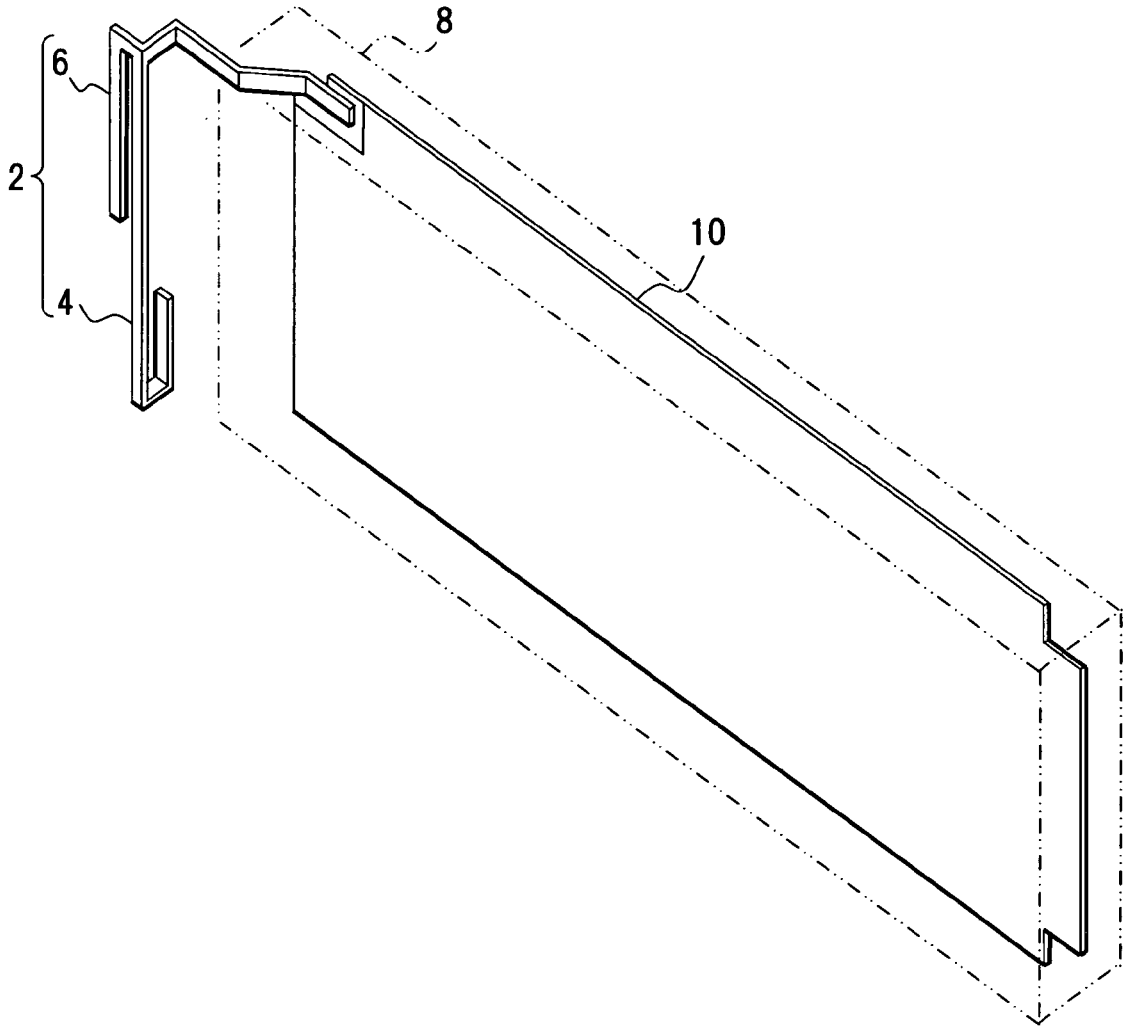
FIG. 2 shows an antenna structure of a cellular phone.
Figure 3:
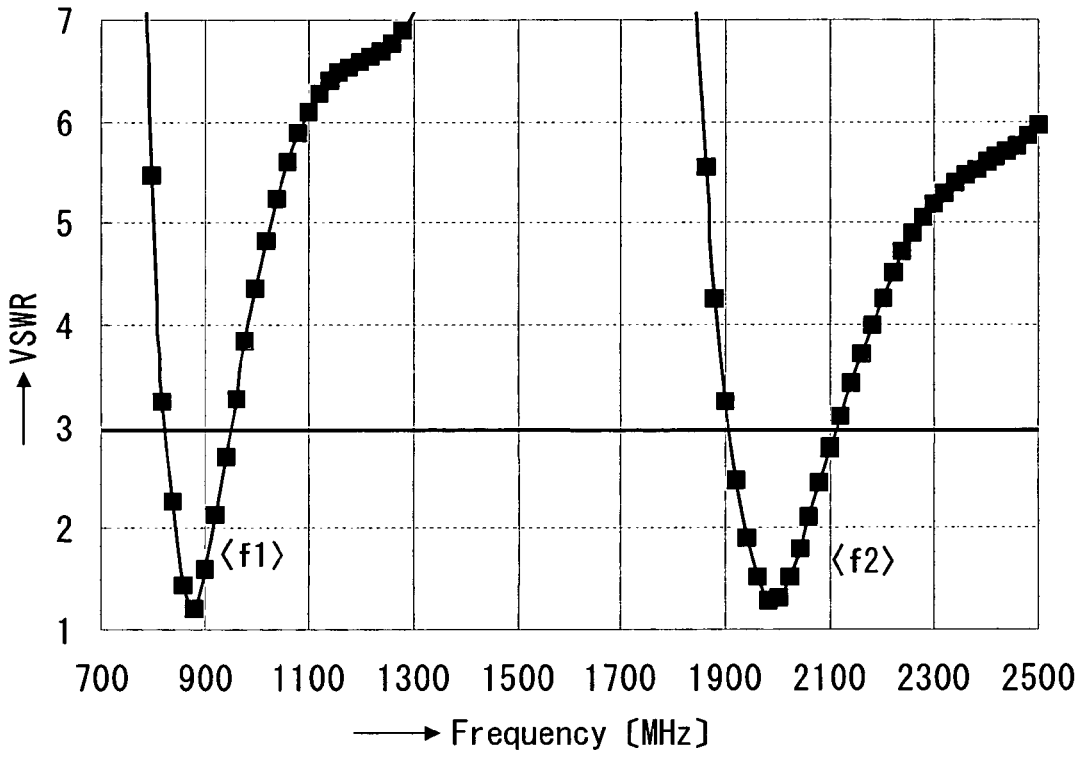
FIG. 3 shows a VSWR characteristic of an antenna.
Figure 4:
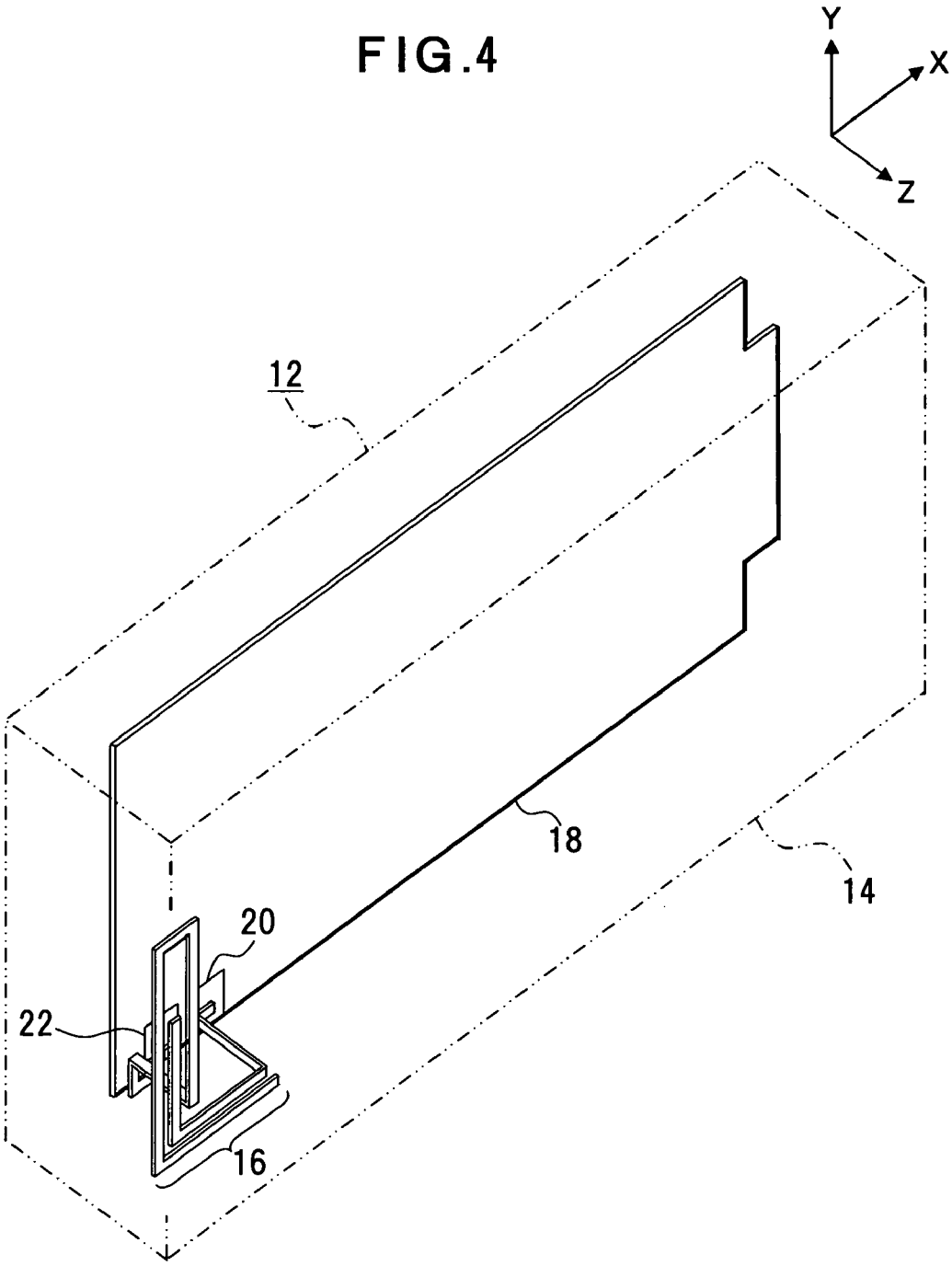
FIG. 4 shows an antenna and a cellular phone according to a first embodiment.
Figure 5:
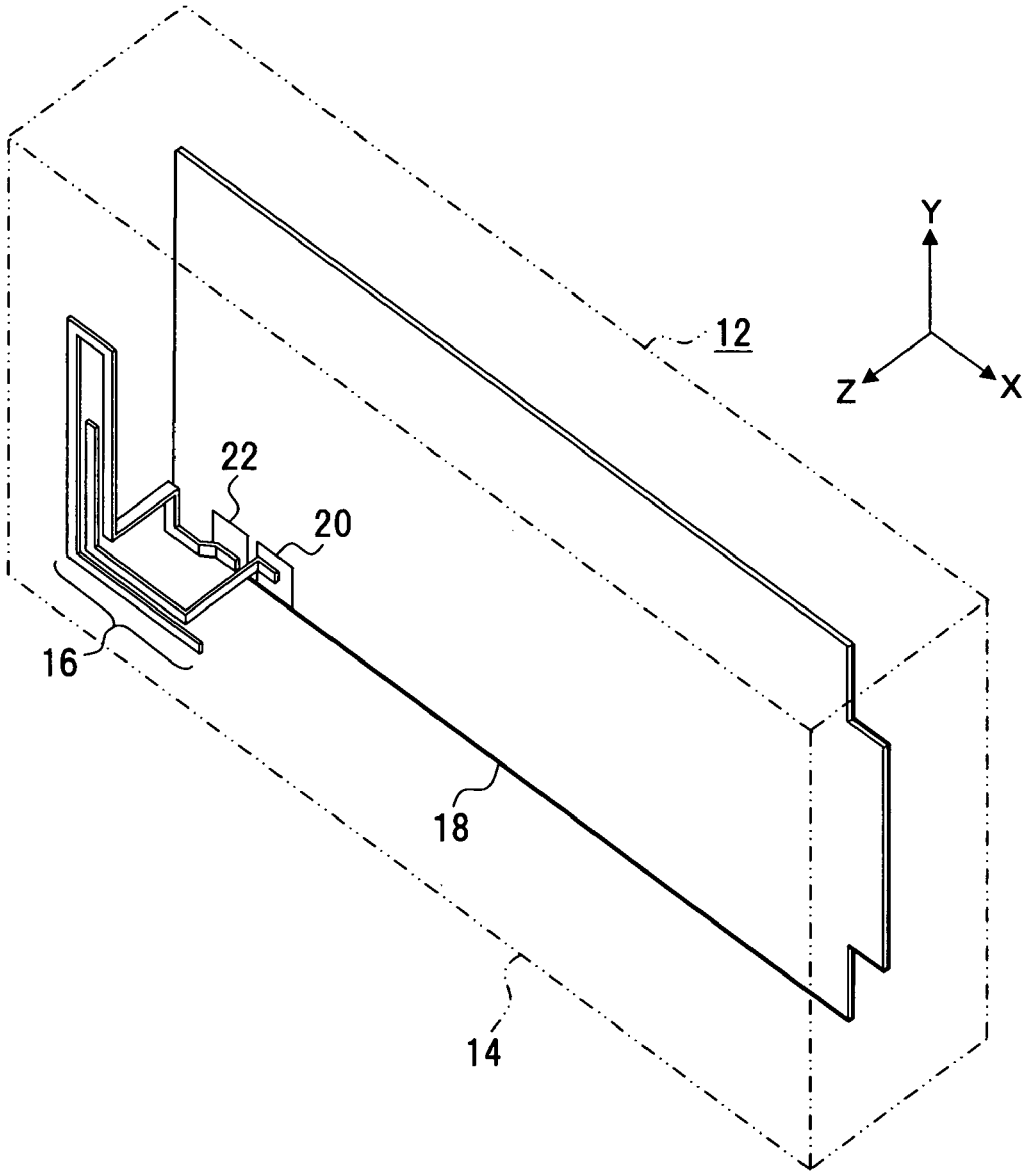
FIG. 5 shows an antenna and a cellular phone according to the first embodiment.

A first embodiment of the present invention will be described with reference to FIGS. 4 and 5. FIG. 4 is a perspective view of an outline of a cellular phone and FIG. 5 is a perspective view of the cellular phone shown in FIG. 4 when the housing is turned. In FIGS. 4 and 5, the same symbols are added to the common portions.

Figure 14:
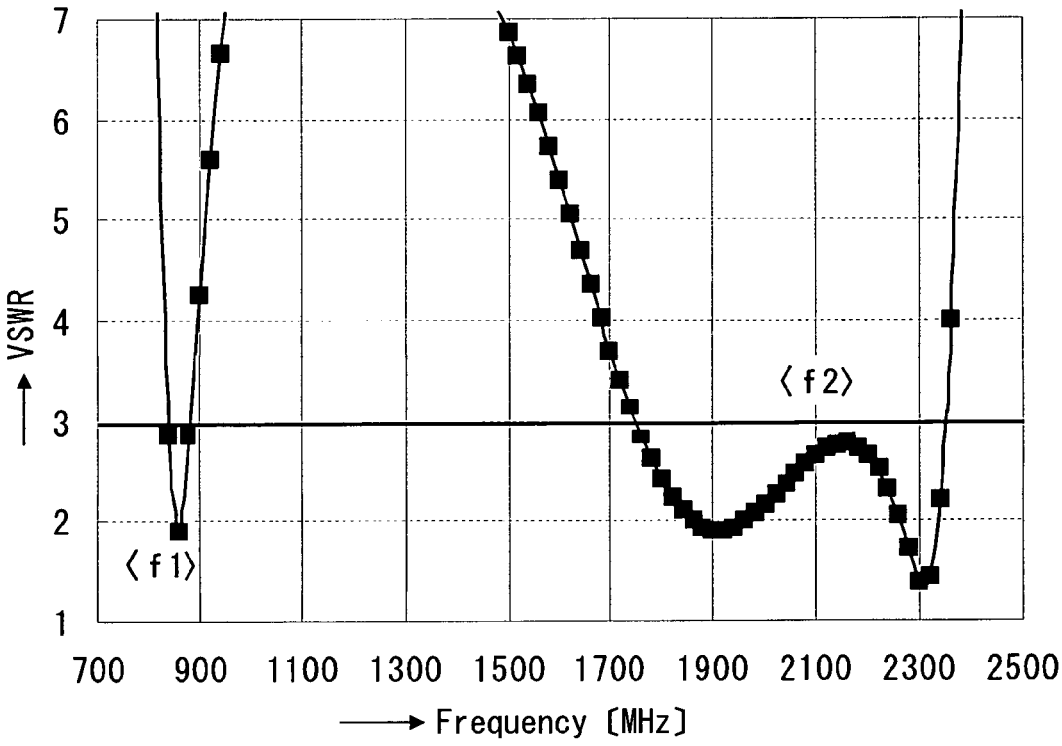
FIG. 14 shows a VSWR characteristic of the antenna according to the first embodiment.

A cellular phone 12 is an example of a wireless communication device and a housing 14 houses an antenna 16 along with a circuit substrate 18, which is provided with a feeding portion 20 and a grounding portion (GND) 22 for connecting the antenna 16. The antenna 16 can communicate at a first target frequency f1 (hereinafter, "frequency f1") and a second target frequency f2 (hereinafter, "frequency f2"); at the frequency f1, the antenna 16 operates as an inverted F antenna; and at the frequency f2, the antenna 16 operates in the same way as a dipole antenna and the frequency f2 can be made broadband (FIG. 14).

In the region for the same operation as a dipole antenna, since currents are concentrated on the antenna 16, less current flows through the housing 14 and the circuit substrate 18 and less effect is exerted by a body of a person holding the cellular phone 12. Even when the antenna 16 is installed on the surface of the circuit substrate 18, the characteristic deterioration does not occur; the antenna function is not impaired; the antenna 16 can be completely housed within the housing 14; and any inconvenience is not caused, such as a projecting portion formed by the antenna portion on the housing 14.

Figure 6:
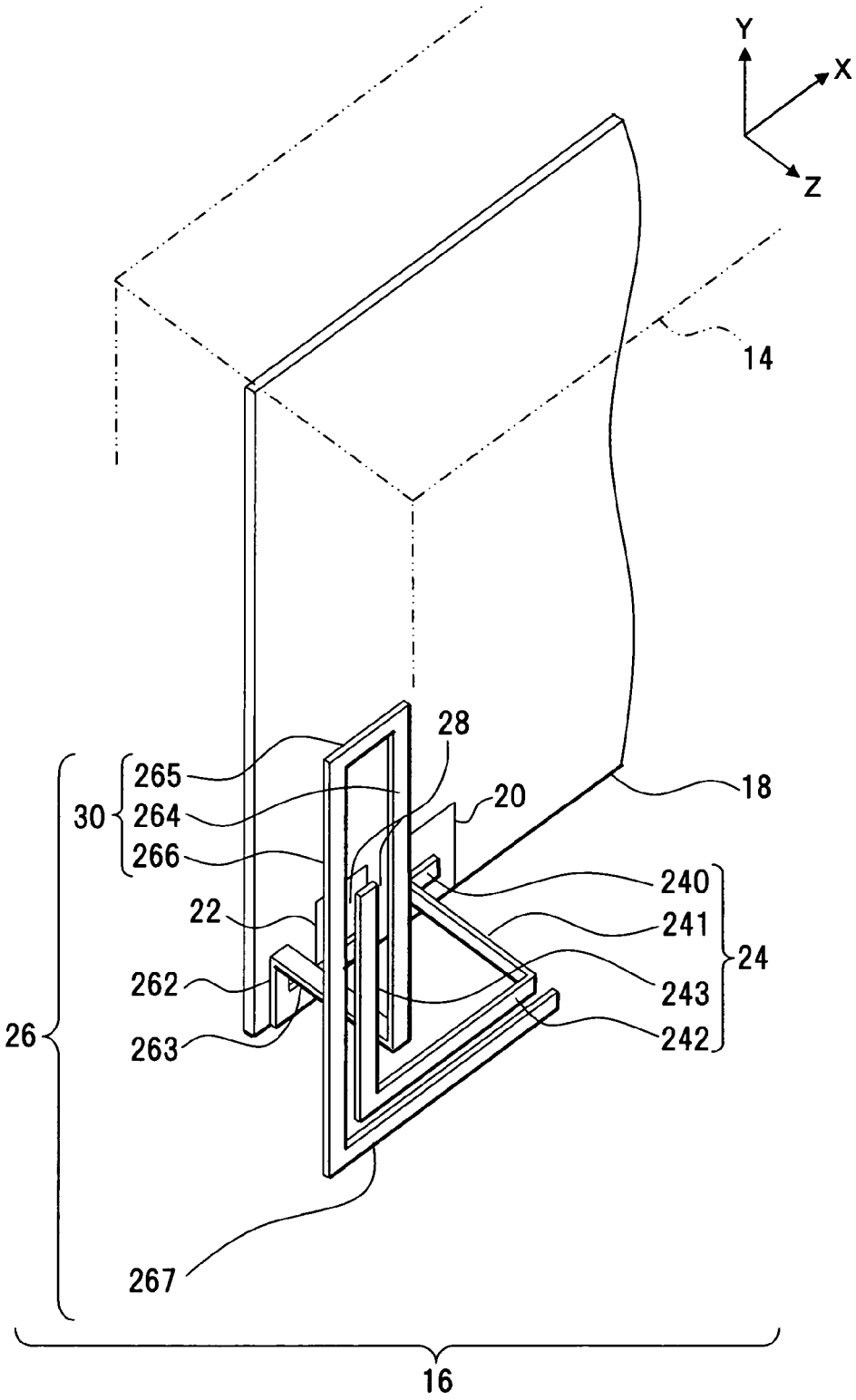
FIG. 6 shows an antenna structure.
Figure 7:
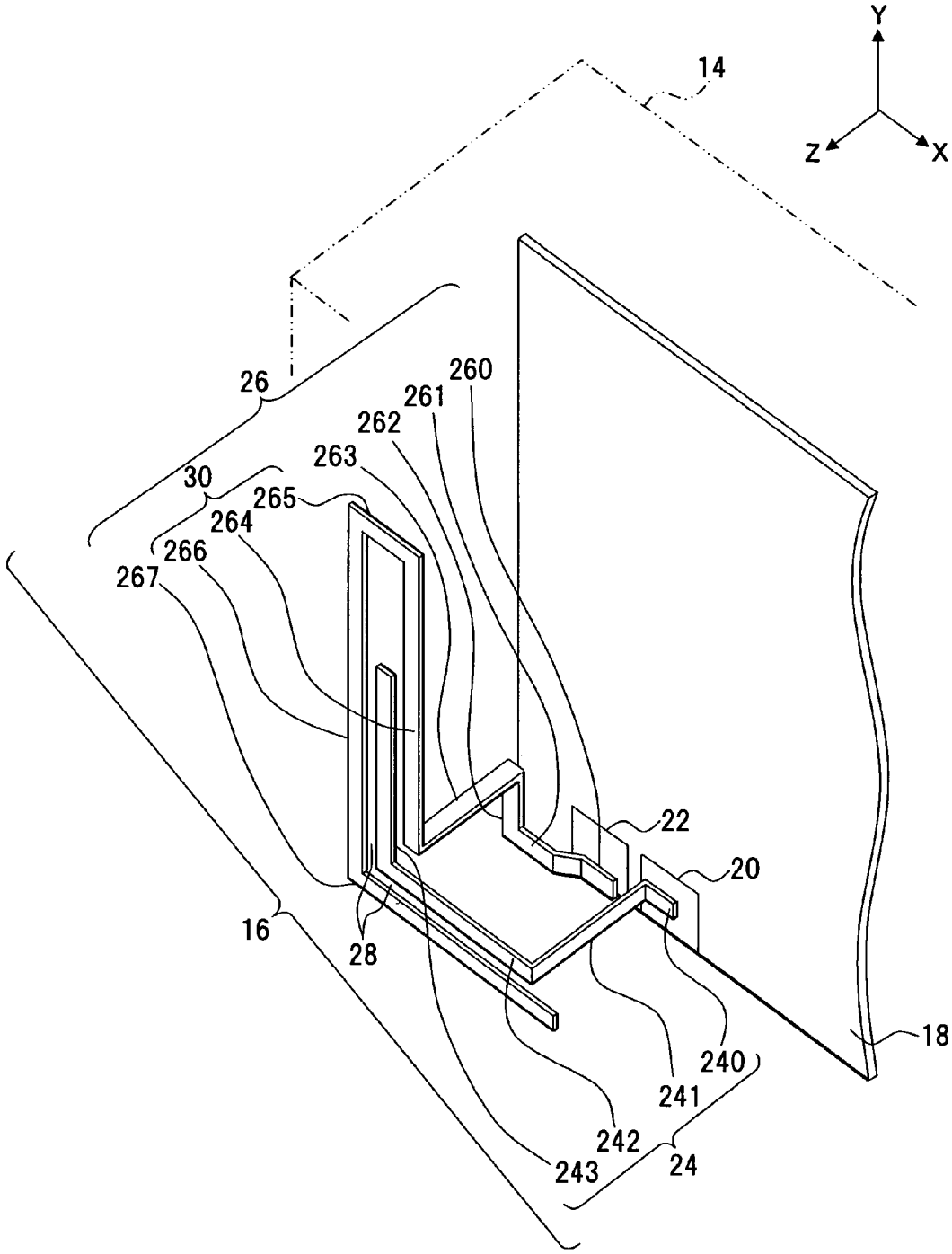
FIG. 7 shows an antenna structure.
Figure 8:
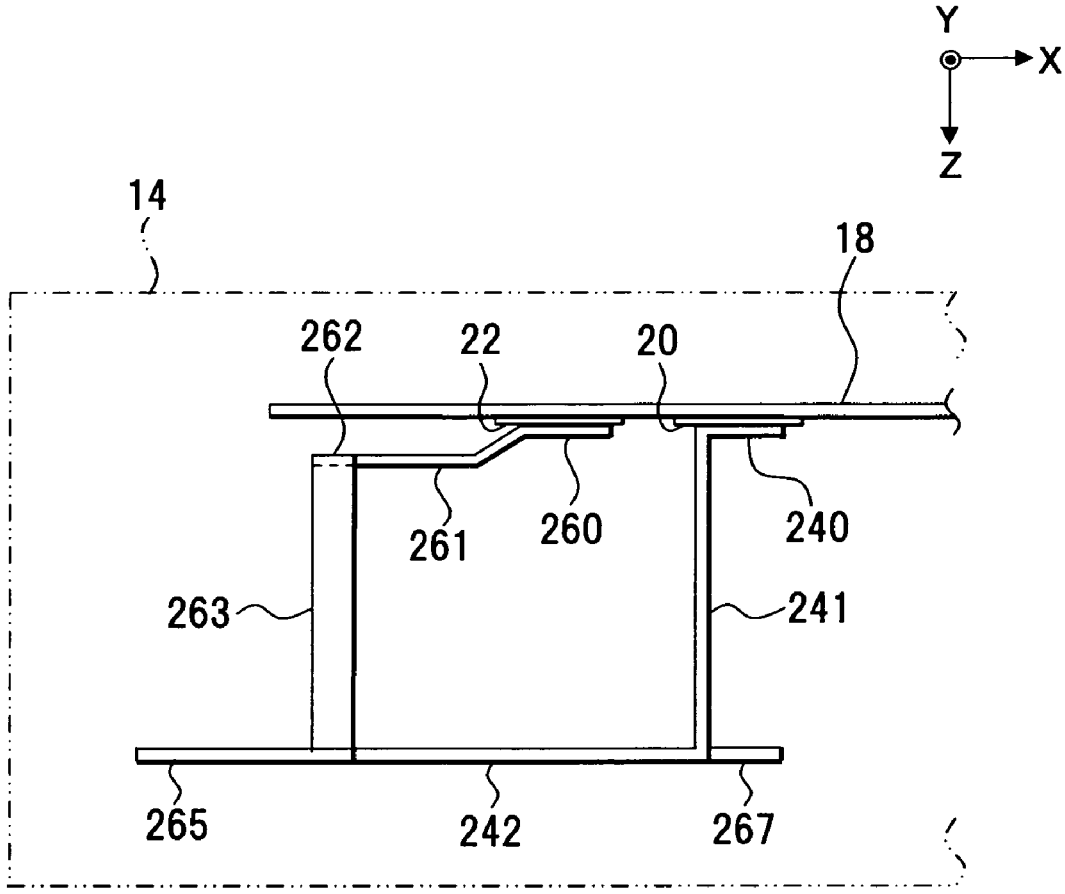
FIG. 8 is a plan view of an antenna portion.
Figure 9:
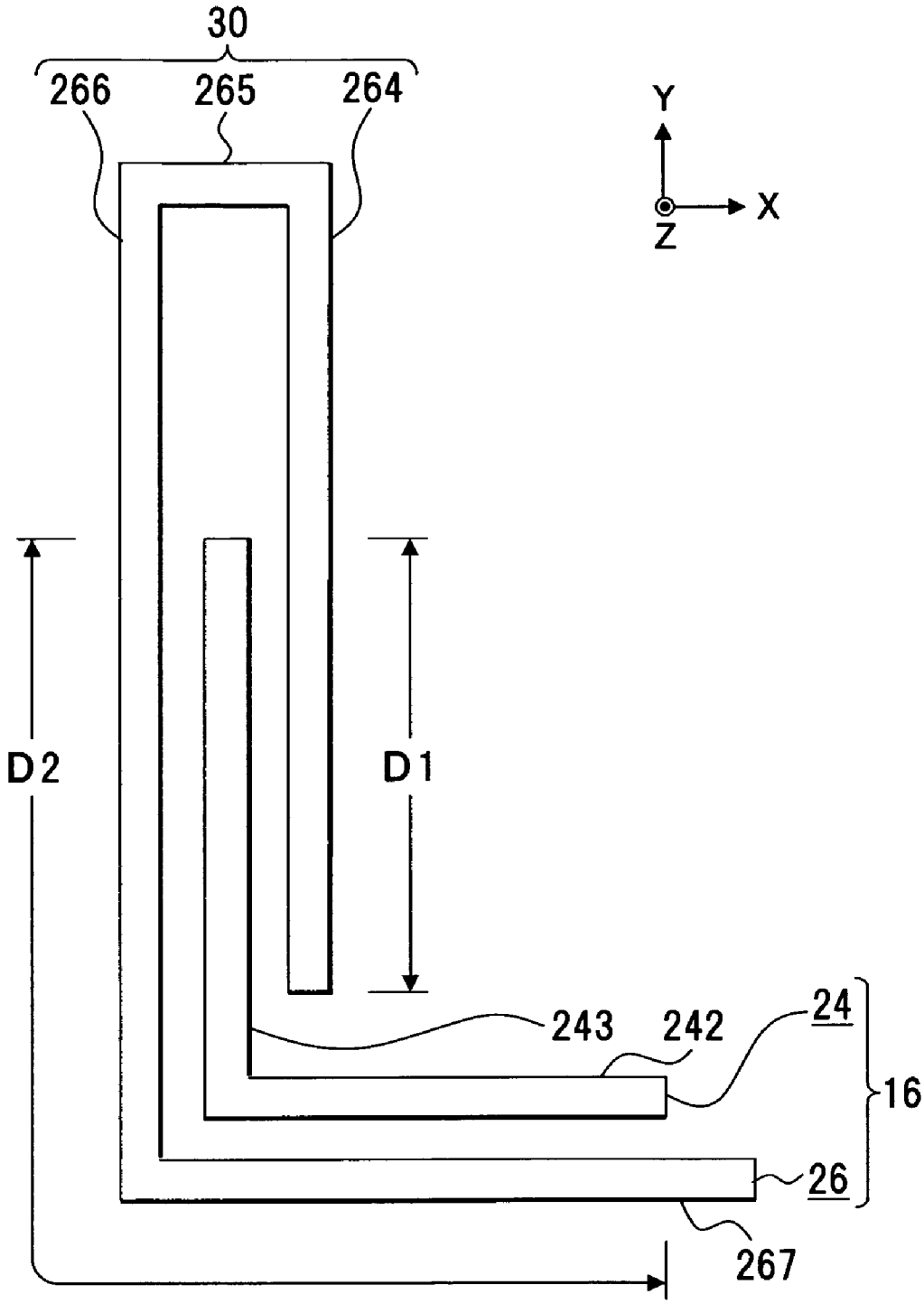
FIG. 9 shows a turn-back portion and an overlap portion of elements of the antenna.

The structure of the antenna 16 will be described with reference to FIGS. 6, 7, 8, and 9. FIG. 6 is a perspective view of the element structure of the antenna 16; FIG. 7 is a perspective view of the antenna element structure shown in FIG. 6 viewed from different angle; FIG. 8 is a plan view of the antenna portion; FIG. 9 shows overlap element portions of elements. In FIGS. 6 to 9, the same symbols are added to the common portions or the portions same as those of FIGS. 4 and 5.

The antenna 16 includes first and second elements 24, 26; the element 24 is connected to the feeding portion 20; the element 26 is connected to the GND 22 of the circuit substrate 18; the both elements are not connected to each other and are coupled by the coupling feeding (indirect feeding).

For example, the element 24 is a bending unit made of a single conductor and is constituted by a feeding point 240 and element portions 241, 242, 243. To clarify the shape of the element 24 and the positional relationships of the feeding points 240 and the element portions 241, 242, 243, when the circuit substrate 18 is used as a reference plane to assume that a length direction, a width direction, and a thickness direction (penetrating direction) are an X-axis, a Y-axis, and a Z-axis, respectively, the element portion 241 is a horizontal portion rising from the circuit substrate 18 in the Z-axis direction; the element portion 242 is a horizontal portion bent from the element portion 241 and extended in parallel with the circuit substrate 18 in the X-axis direction toward the end thereof; and the element portion 243 is a vertical portion bent from the element portion 242 and extended in parallel with the circuit substrate 18 in the Y-axis direction toward the end thereof.

The element 26 is a bending unit including a plurality of element portions as is the case with the element 24, and the element portions constituting the element 26 are a grounding portion 260 and element portions 261, 262, 263, 264, 265, 266, 267. The grounding portion 260 is connected to the GND 22 of the circuit substrate 18; the element portion 261 is a horizontal portion that is slightly away from the circuit substrate 18 and extended in the X-axis direction; and the element portion 262 is a vertical portion bent from the element portion 261 to the Y-axis direction. The element portion 263 is a horizontal portion bent from and disposed on the element 262 in the Z-axis direction; the element portion 264 is a vertical portion bent and raised from the element portion 263 in the Y-axis direction; the element portion 265 is a horizontal portion extended from the element portion 264 in the X-axis direction; the element portion 266 is a vertical portion bent from the element portion 265 in the Y-axis direction; and the element portion 267 is a horizontal portion bent from the element portion 266 in the X-axis direction. In the element 26, a turn-back portion 30 is formed with the element portions 264, 265, 266 and the element portion 243 of the element 24 is located in a space of the turn-back portion 30.

In such elements 24, 26, the element portion 241 and the element portion 263 are disposed in parallel; the element portion 242 and the element portion 267 are provided with an insulating space 28 and disposed in parallel; the element portion 243, the element portion 264, and the element portion 266 are provided with an insulating space 28 and disposed in parallel. In this case, the element portion 265 disposed between the element portion 264 and the element portion 266 is in parallel with the element portions 242, 267.

When comparing the elements 24, 26, as shown in FIG. 9, an overlap portion D1 exists in the element portion 243 and the element portion 264; an overlap portion D2 exists in the element portions 242, 243 and the element portions 266, 267; and the capacity coupling can be obtained with these overlap portions D1, D2 to achieve the coupling feeding between the elements 24, 26.

Figure 10:
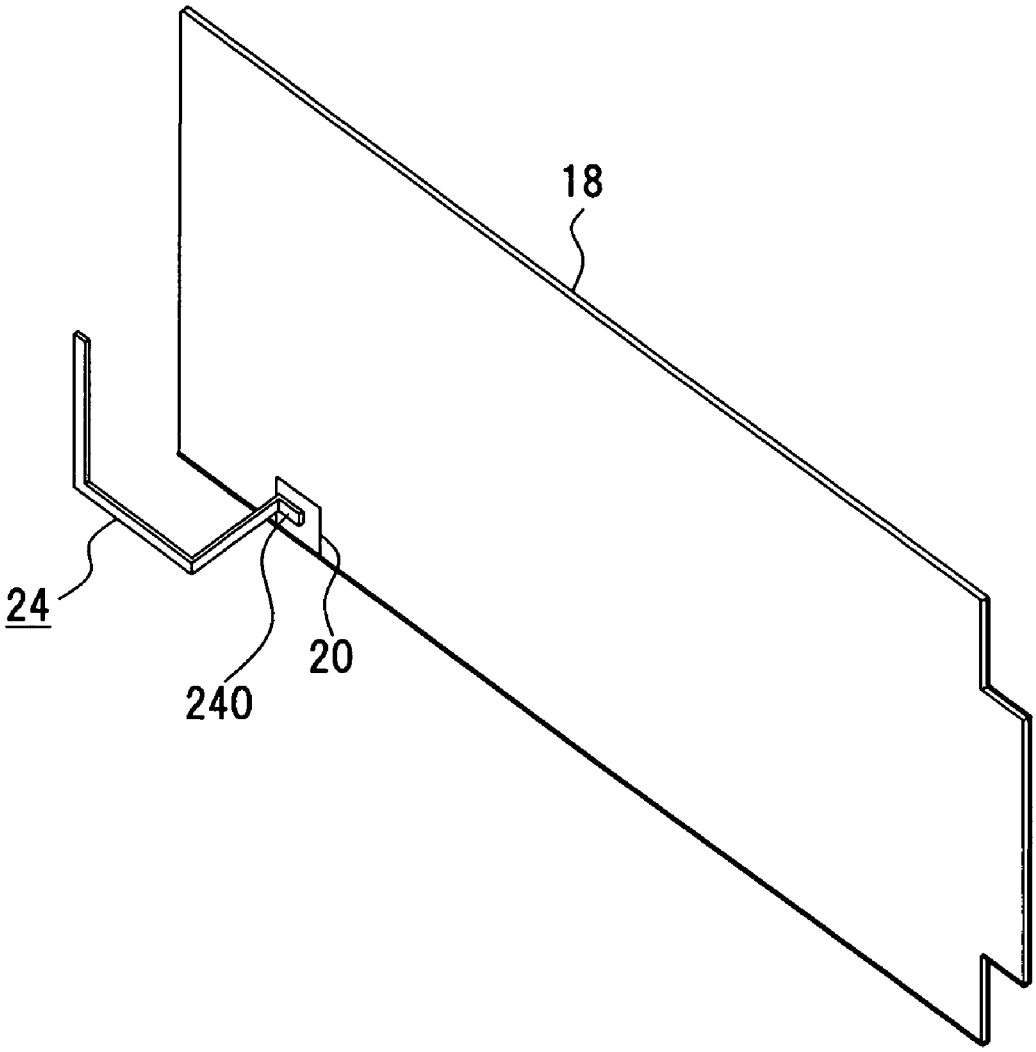
FIG. 10 shows an antenna including only a first element.
Figure 11:
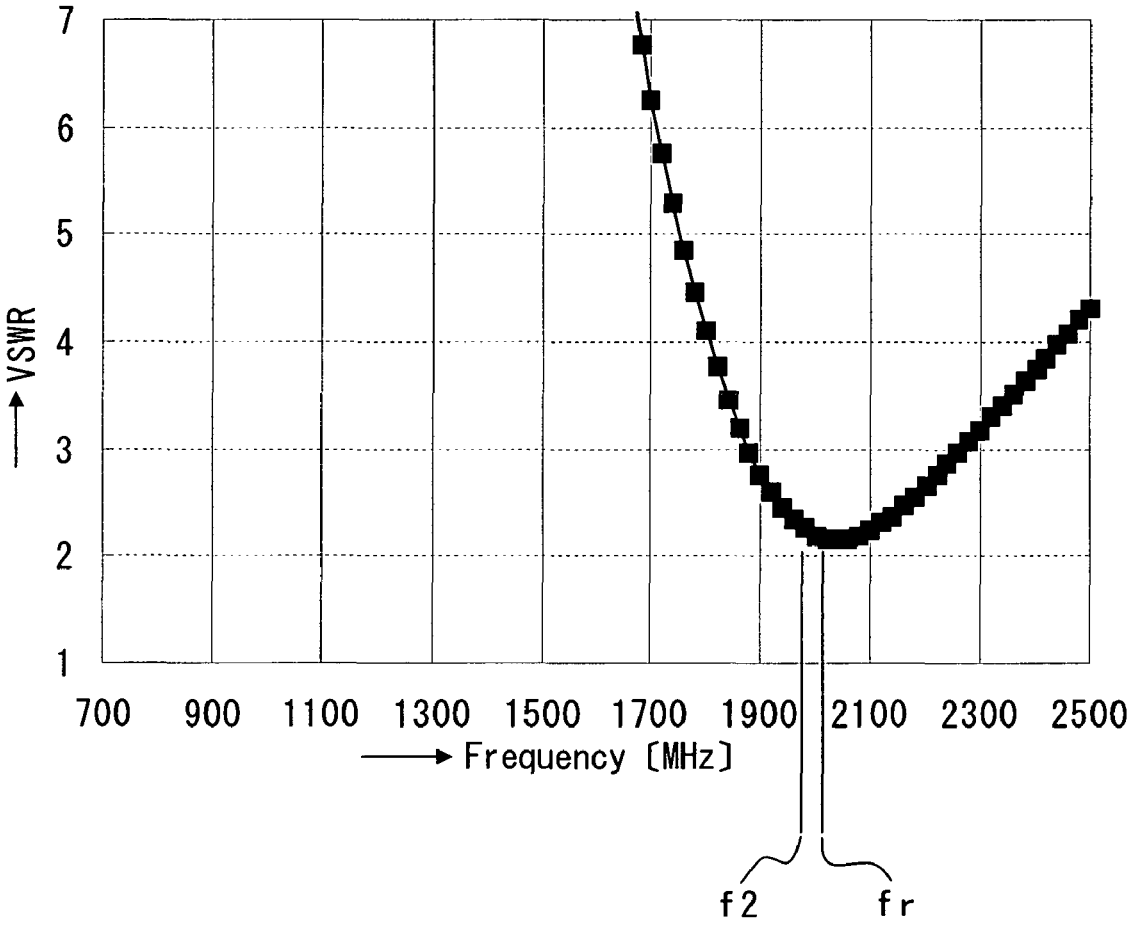
FIG. 11 shows a VSWR characteristic of the first element.

As shown in FIG. 10, when the element 24 is used as an antenna and the length L1 thereof is adjusted to a length resonated by the frequency f2, i.e., the target frequency, a VSWR characteristic shown in FIG. 11 can be obtained from the element 24. In this case, for example, when the frequency f2, i.e., the target frequency is 2 [GHz], the resonance frequency fr of the element 24 is set slightly higher than the frequency f2 (fr>f2). The resonance frequency fr is set higher than the frequency f2 in this way because the resonance frequency fr is reduced by the proximity to the element 26 and set higher in consideration of the reduction.

Figure 12:
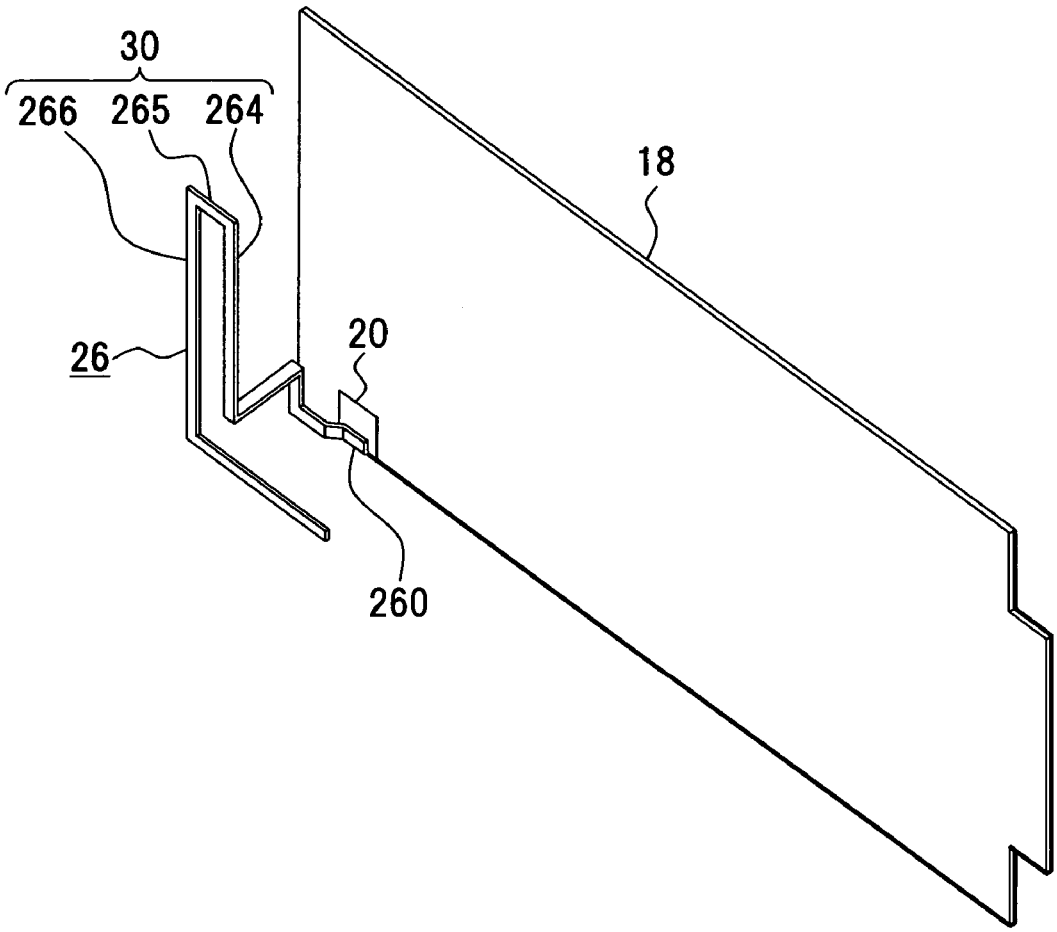
FIG. 12 shows an antenna including only a second element.
Figure 13:
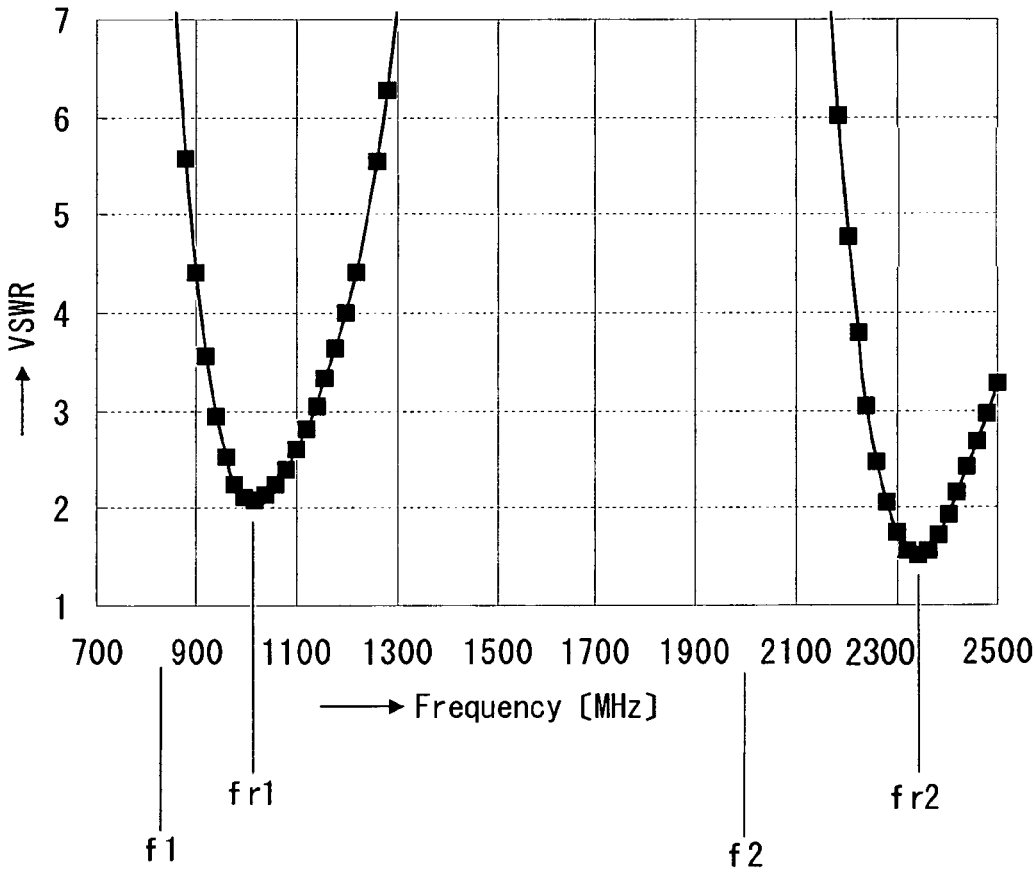
FIG. 13 shows a VSWR characteristic of the second element.

As shown in FIG. 12, the element 26 is used as an antenna, and the aforementioned grounding portion 260 is defined to be a feeding point and connected to the feeding portion 20. If the length L2 of the element 26 is adjusted to a length resonated by the frequency f1, a VSWR characteristic shown in FIG. 13 can be obtained from the element 26. As shown in FIG. 13, The primary resonance frequency fr1 of the element 26 is set higher than the frequency f1. Since the resonance frequency fr1 is reduced by the proximity to the element 24, the resonance frequency fr1 is set higher in consideration of the reduction. The high-order resonance frequency fr2 is also set higher then the frequency f2. Similarly, since the resonance frequency fr2 is reduced by the proximity to the element 24, the resonance frequency fr2 is set higher in consideration of the reduction.

In the element 26, the turn-back portion 30 is formed on a plane and the high-order resonance frequency is adjusted by the position of the turn-back portion 30. The adjusting method will be described later.

Since the antenna 16 is constituted by combining the elements 24, 26, at the frequency f1, the antenna 16 operates as an inverted F antenna where the element 26 is a main radiating element, and at the frequency f2, the antenna 16 operates as a pseudo-dipole antenna where the both elements 24 and 26 are radiating elements, that is, the same operation as a dipole antenna can be obtained. Since the high-order mode resonance of the inverted F antenna is combined at the frequency f2, the frequency f2 is made broadband.

In the antenna 16, a combined characteristic is generated by overlapping the VSWR characteristics (FIGS. 11 and 13)

of the elements 24, 26, and a VSWR characteristic shown in FIG. 14 can be obtained. According to this VSWR characteristic, while the frequency f1 has a narrow band because of the inverted F antenna operation, the frequency f2 has a broadband with a bandwidth of 600 [MHz] or more. It is obvious from this characteristic that the frequency f1 is obtained which is a frequency lower than the resonance frequency fr1 and that the frequency f2 is obtained which is lower than the resonance frequency fr2 and which is made broadband.

Figure 15:
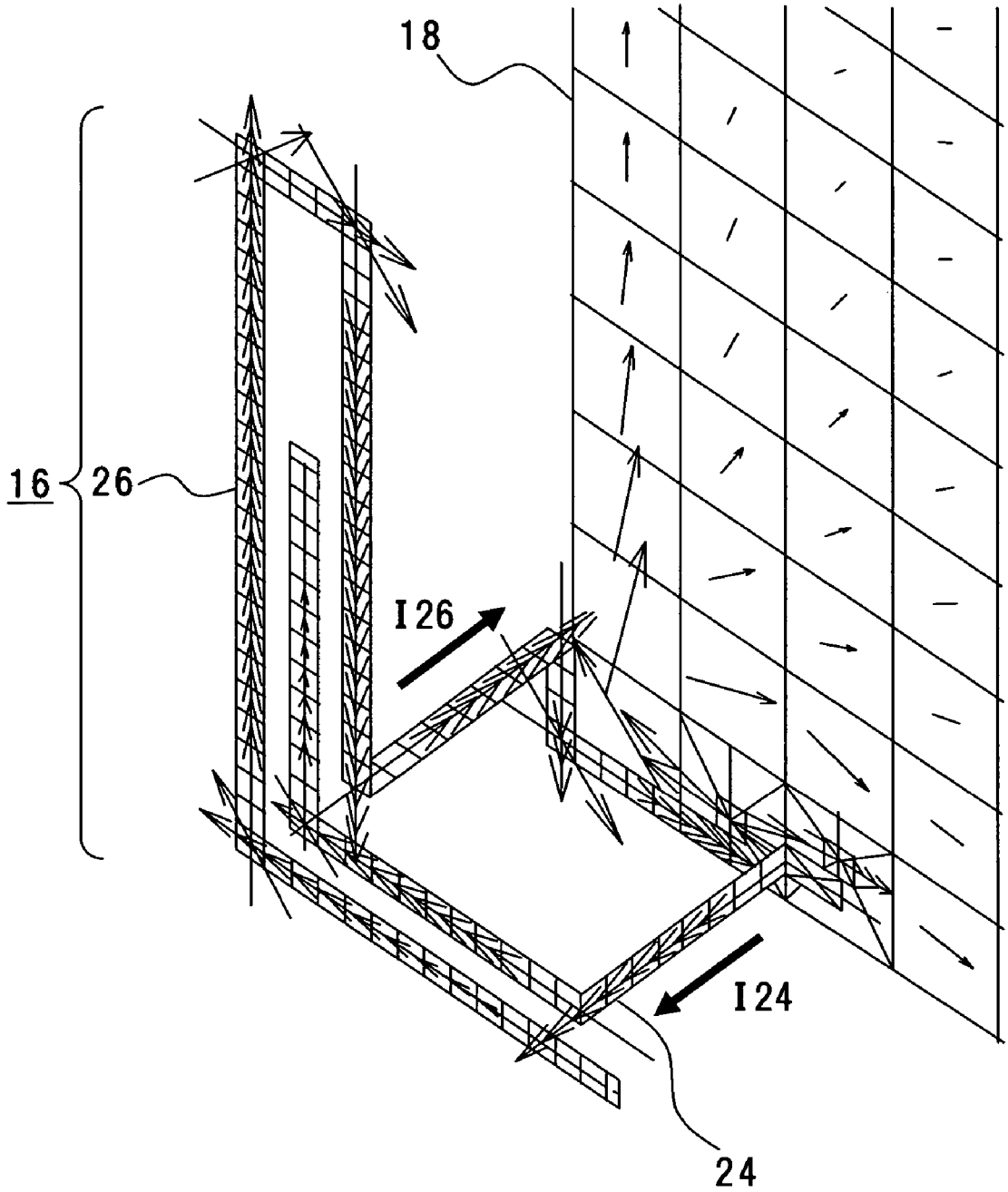
FIG. 15 shows a current distribution (860 [MHz]) of the antenna.

The operation modes of the antenna 16 are described with reference to FIGS. 15 to 20. FIG. 15 shows a current distribution at the frequency f1; FIGS. 16 to 19 show current distributions at frequency f2; and FIG. 20 shows an out-of-band current distribution of the frequency f2.

At the frequency f1, as shown in FIG. 15 (f1=860 [MHz]), a direction of a current I24 flowing through the element 24 is reversed from a direction of a current I26 flowing through the element 26. In such a case, it is known that the antenna 16 operates as the inverted F antenna where the element 26 is a main radiating element. That is, the antenna 16 constitutes the inverted F antenna at the frequency f1.

Figure 16:
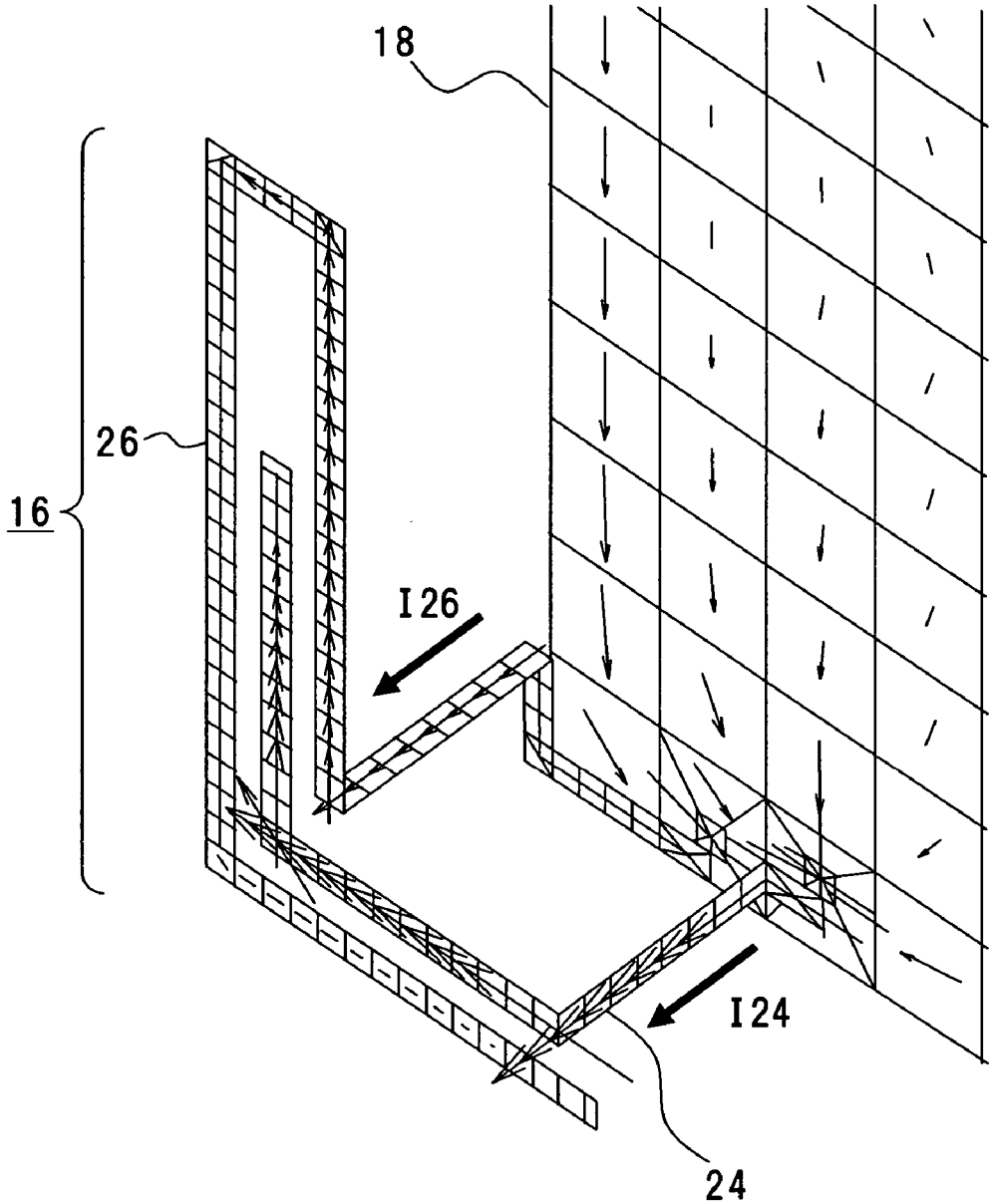
FIG. 16 shows a current distribution (1800 [MHz]) of the antenna.
Figure 17:
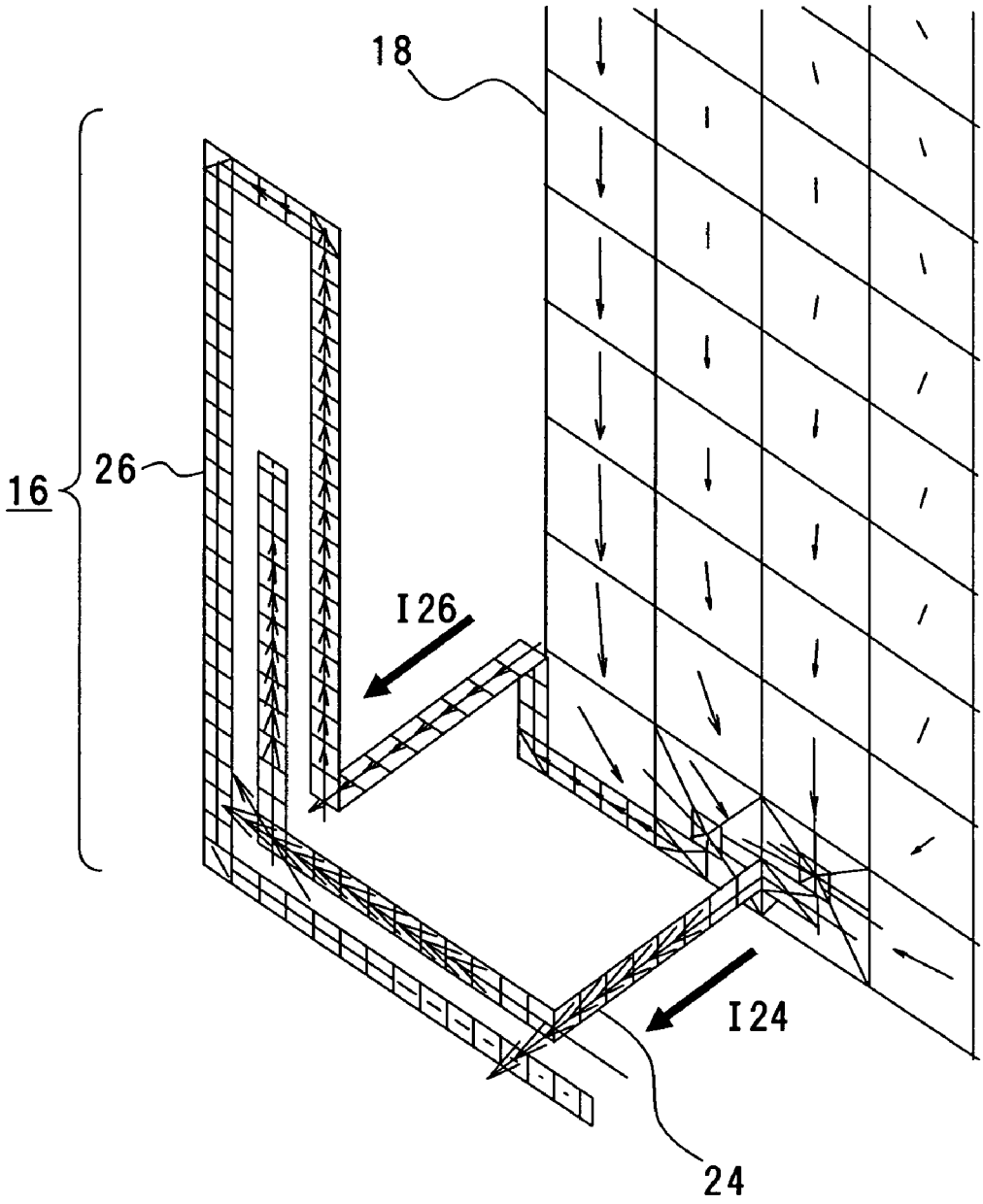
FIG. 17 shows a current distribution (1900 [MHz]) of the antenna.
Figure 18:
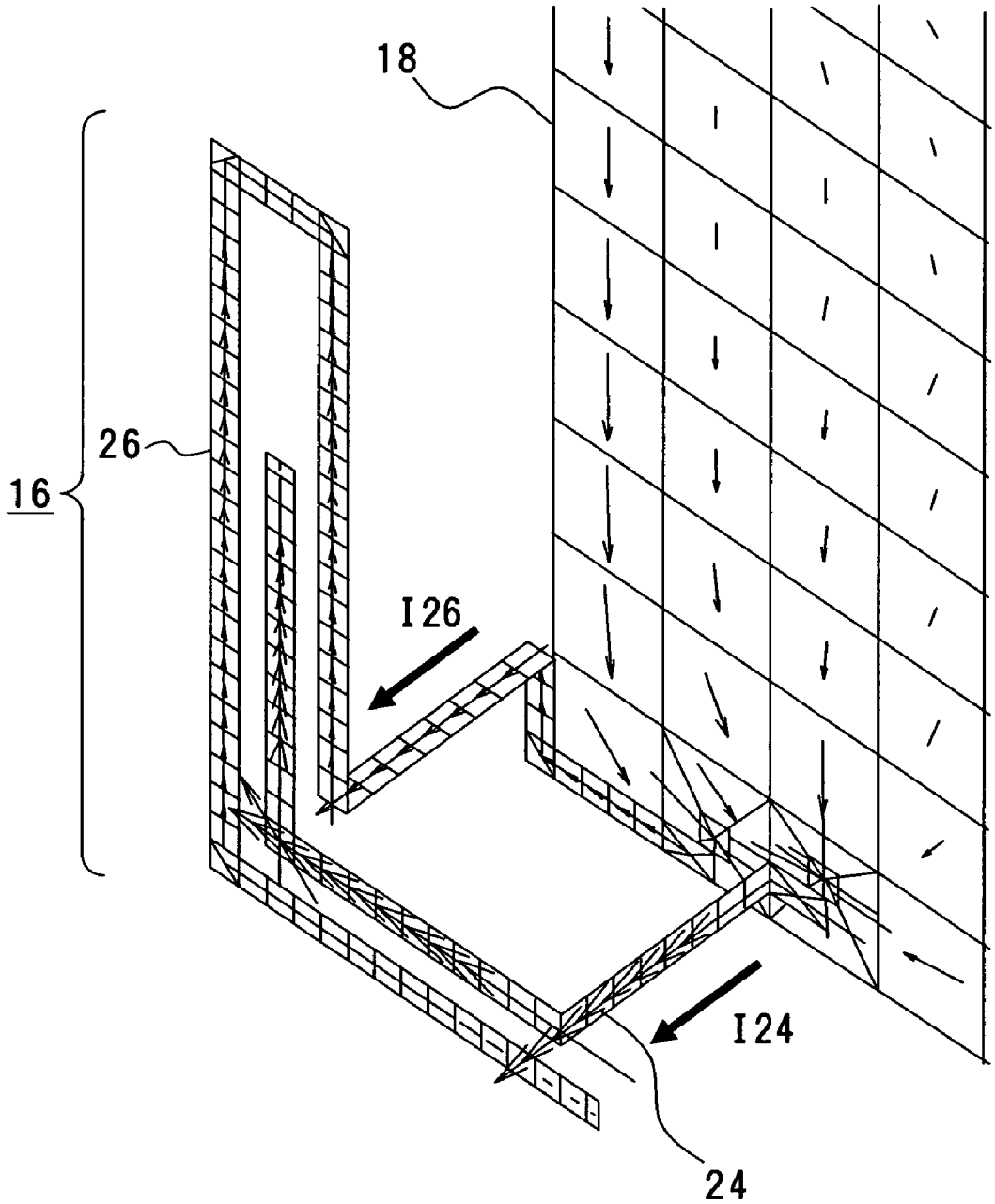
FIG. 18 shows a current distribution (2000 [MHz]) of the antenna.
Figure 19:
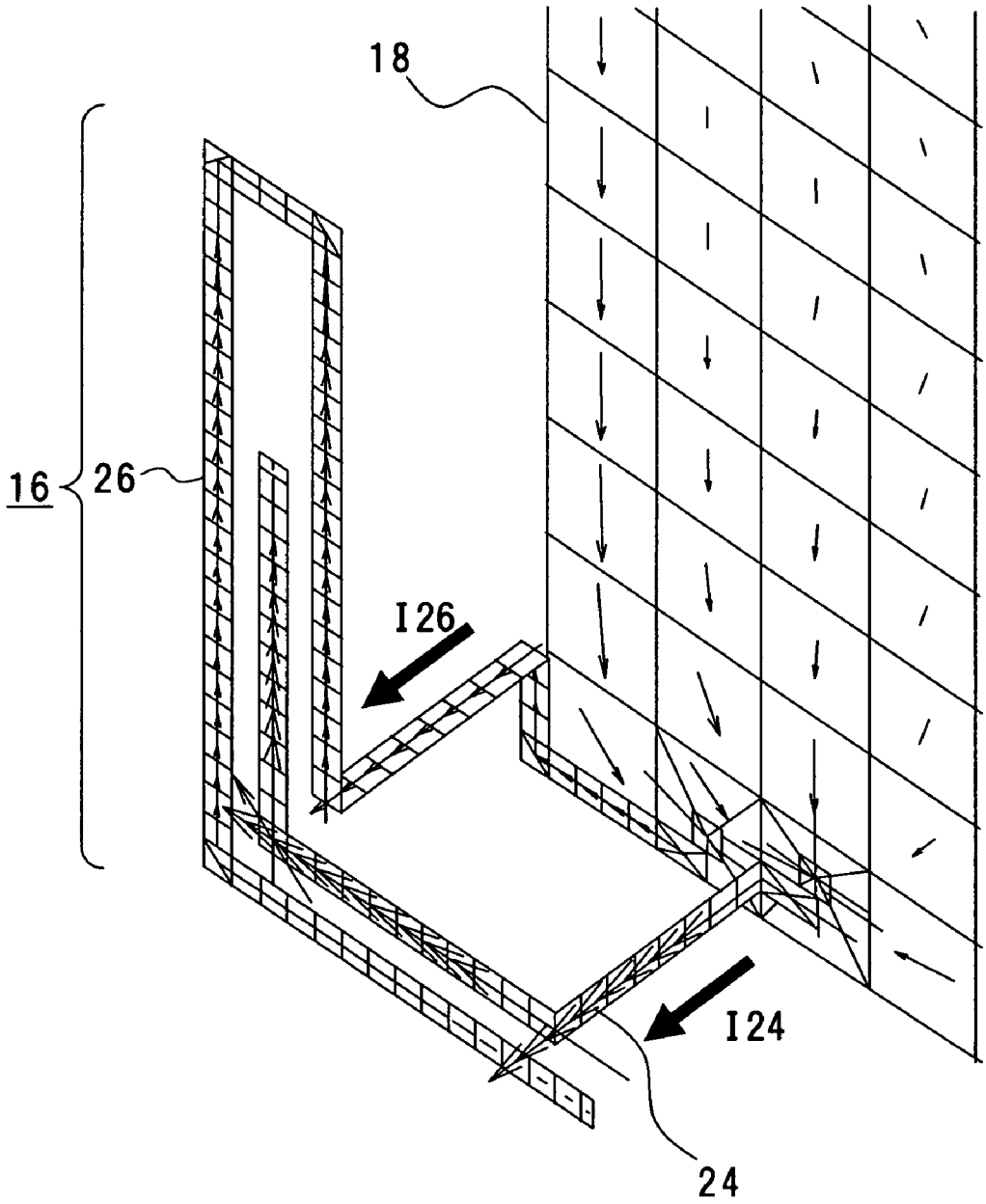
FIG. 19 shows a current distribution (2100 [MHz]) of the antenna.
Figure 20:
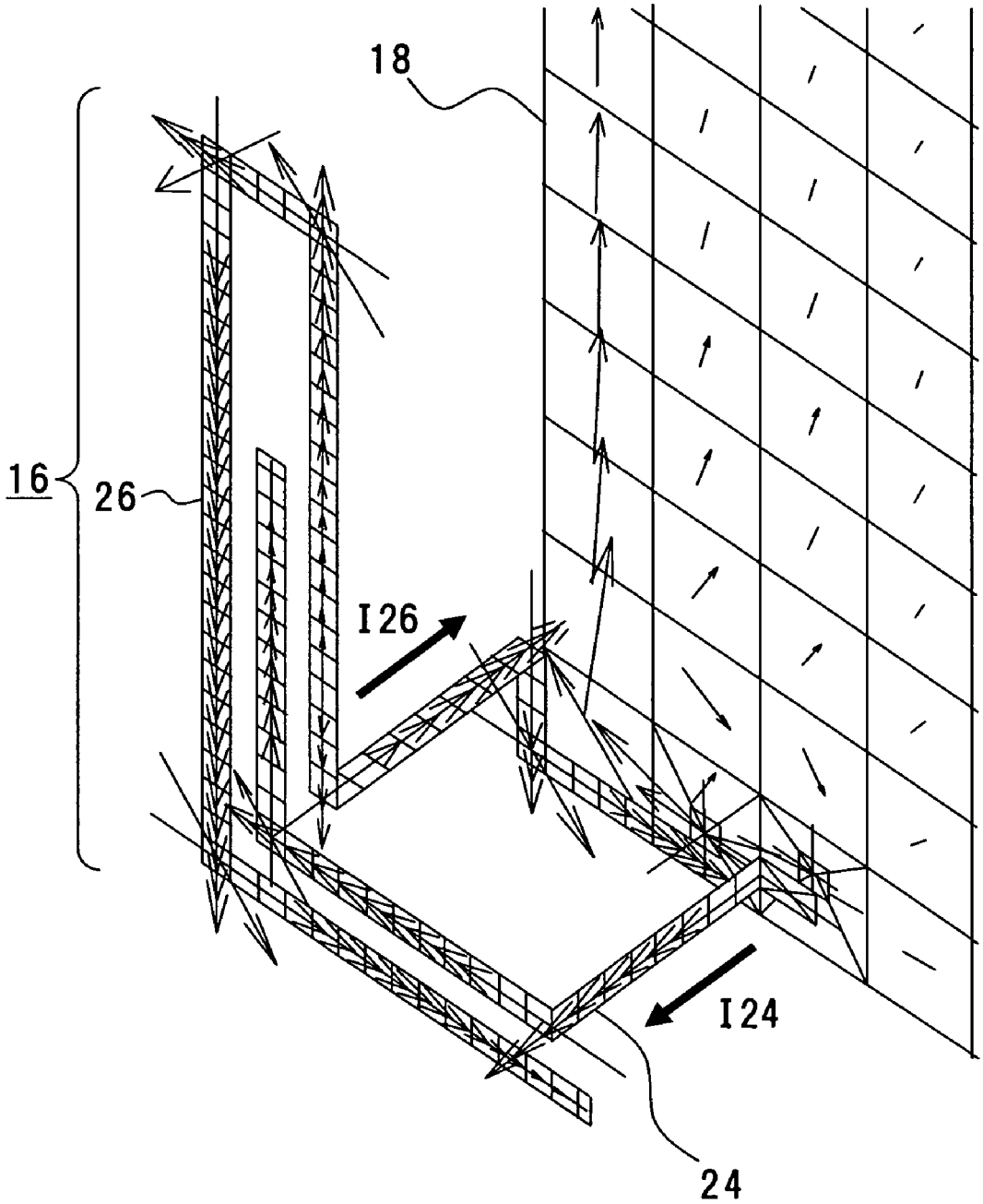
FIG. 20 shows a current distribution (2300 [MHz]) of the antenna.

At the frequency f2, as shown in FIG. 16 (f2=1800 [MHz]), FIG. 17 (f2=1900 [MHz]), FIG. 18 (f2=2000 [MHz]), and FIG. 19 (f2=2100 [MHz]), the direction of the current I24 flowing through the element 24 is the same as the direction of the current I26 flowing through the element 26. In such a case, it is known that the antenna 16 operates as the pseudo-dipole antenna where the both element 24 and element 26 are radiating elements. Since a genuine dipole antenna has each element length of $\lambda/4$ and the antenna 16 has the elements 24, 26 with different lengths, the operation of the antenna 16 is not different from that of the dipole antenna, although referred to as the pseudo-dipole antenna. That is, the antenna 16 constitutes the dipole antenna at the frequency f2.

It is obvious from such operation modes that when the antenna 16 is in the dipole antenna mode, since currents are concentrated on the elements 24, 26, less current flows through the circuit substrate 18 and the housing 14 and less effect is exerted by an adjacent human body. Therefore, the antenna 16 of the embodiment not only can make the frequency f2 broadband but also constitutes an antenna that is less affected by a human body.

At f3=2300 [MHz] outside of the frequency f2, as shown in FIG. 20, the direction of the current I24 flowing through the element 24 is reversed from the direction of the current I26 flowing through the element 26. This operation mode is the same as the operation of the inverted F antenna and therefore, this is high-order mode resonance of the resonance at the frequency f1. Since such high-order mode resonance is added to the aforementioned dipole antenna mode resonance to generate a resonance synthesis, the frequency f2 can be made broadband.

Second Embodiment

Description will be made of an adjusting method of antenna resonance frequency of the present invention with reference to FIGS. 21A, 21B, 21C, 22A, 22B, 22C, and 23. FIGS. 21A to 21C and FIGS. 22A to 22C show adjustment of element shapes for an adjusting method of high-order mode resonance frequency and FIG. 23 shows VSWR characteristics corresponding to the element shapes. In FIGS. 21A to 23, the same symbols are added to the portions same as those of FIGS. 5, 7, and 12.

In the element 26 of the antenna 16, the length L2 of the element 26 is adjusted to obtain the resonance frequency fr1 higher than the frequency fr1, as described above.

Figure 21A:
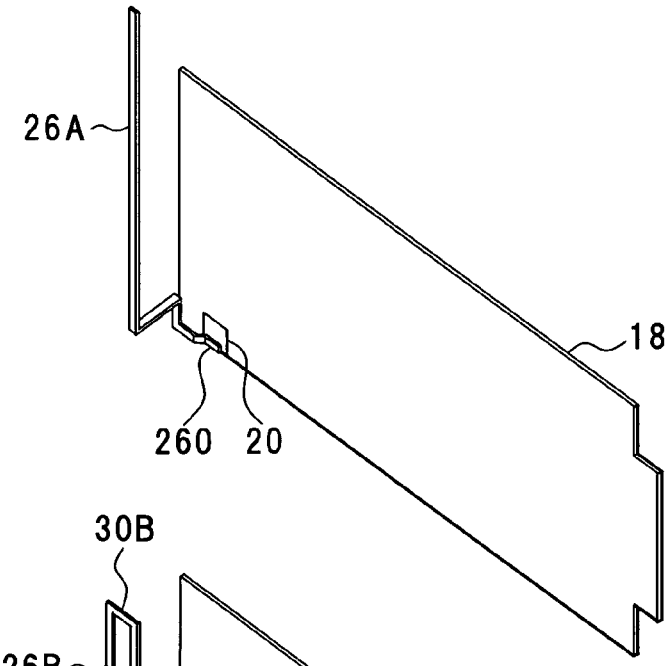
FIGS. 21A, 21B, and 21C show an antenna frequency adjusting method according to a second embodiment.
Figure 22A:
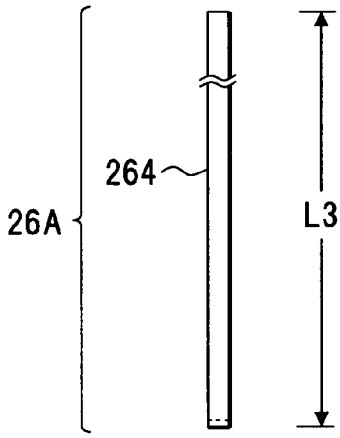
FIGS. 22A, 22B, and 22C show an antenna frequency adjusting method according to a second embodiment.
Figure 23:
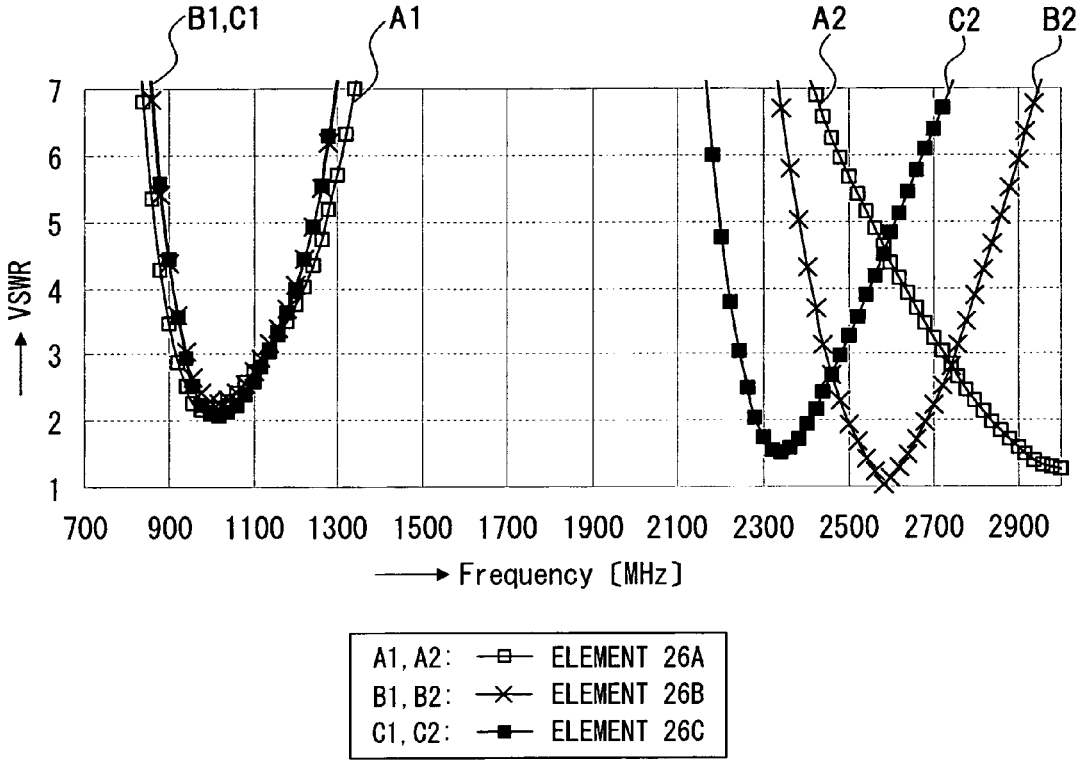
FIG. 23 shows VSWR characteristics when changing the presence and position of the turn-back portion.

As shown in FIGS. 21A and 22A, a straight element 26A is formed and the grounding portion 260 is connected to the feeding portion 20 to constitute an antenna. That is, the element 26A does not have the turn-back portion 30 and a length L3 is a length when the element portions 264, 265, 266, and 267 are linearly arranged.

Figure 21B:
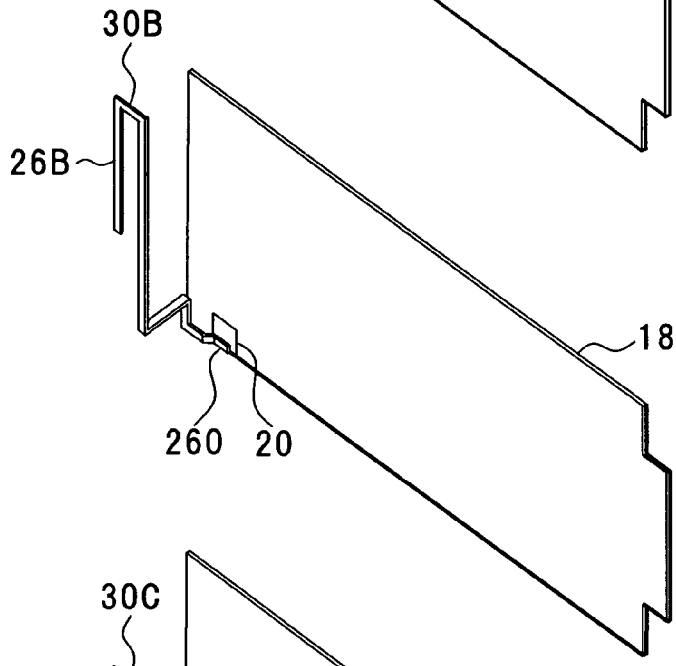
Figure 22B:
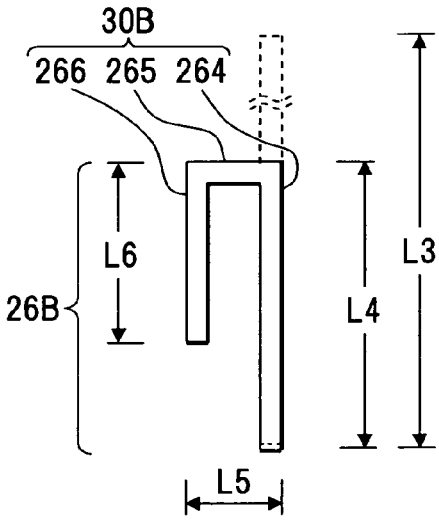

As shown in FIGS. 21B and 22B, an element 26B is formed with a turn-back portion 30B and the grounding portion 260 is connected to the feeding portion 20 to constitute an antenna. That is, although the element 26B includes the turn-back portion 30B, the element portion 266 is short and the element portion 267 does not exist. In the element 26B, the length L3 is equal to a total length of lengths L4, L5, and L6 (L4+L5+L6). In this case, since the element portion 264 is long; the element portion 266 is short; and the element portion 267 does not exist, the turn-back portion 30B is defined at a position higher than the case of the element 26 (FIG. 12).

Figure 21C:
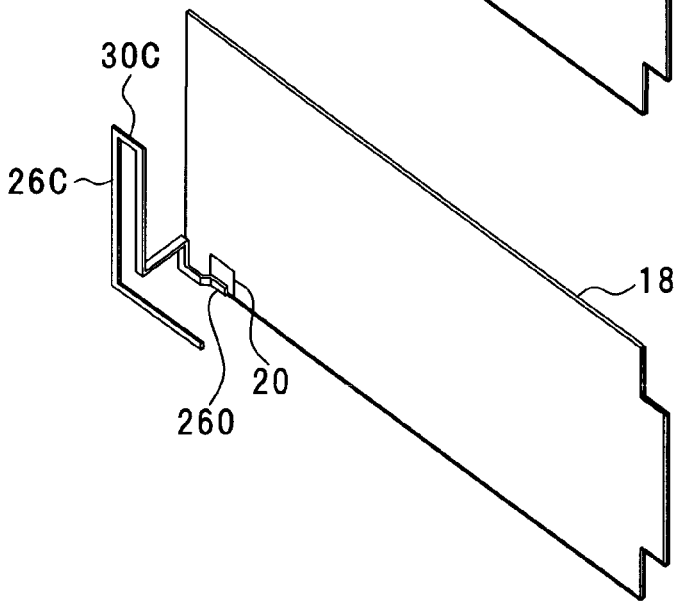
Figure 22C:
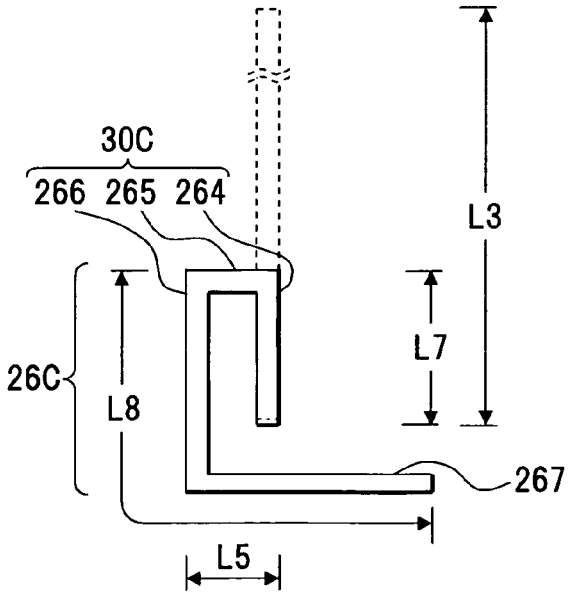

As shown in FIGS. 21C and 22C, an element 26C is formed with a turn-back portion 30C as well as the element portion 267 and the grounding portion 260 is connected to the feeding portion 20 to constitute an antenna. In this case, in the element 26*c*, the turn-back portion 30C and the element portion 267 are formed. In the element 26C, L3 is equal to a total length of lengths L7, L5, and L8 (L7+L5+L8). This element 26C has the same form of the element 26 of the aforementioned antenna 16.

VSWR characteristics shown in FIG. 23 are obtained from the elements 26A, 26B, and 26C. In FIG. 23, A1 is a primary resonance frequency of the element 26A; B1 is a primary resonance frequency of the element 26B; C1 is a primary resonance frequency of the element 26C; A2 is a high-order mode resonance frequency of the element 26A; B2 is a high-order mode resonance frequency of the element 26B; and C2 is a high-order mode resonance frequency of the element 26C.

When the element shapes are changed as shown by each element 26A, 26B, 26C, although the changes in the primary resonance frequency are small, the values of the high-order resonance frequencies are changed considerably and the bandwidths are also changed. It is also known that the high-order resonance frequencies are changed considerably by the positions of the turn-back portions 30B, 30C.

In this way, when the high-order mode resonance frequency is changed by forming the turn-back portions 30B, 30C, if the position of the turn-back portion is properly adjusted, a desired high-order mode resonance frequency can be obtained. Since the characteristic of the element 24 and the characteristic of the element 26 are combined in the antenna 16 including the element 26, the frequency f2 of the antenna 16 can be adjusted to the desired resonance frequency by adjusting the position of the turn-back portion 30 of the element 26.

Third Embodiment

Figure 24:
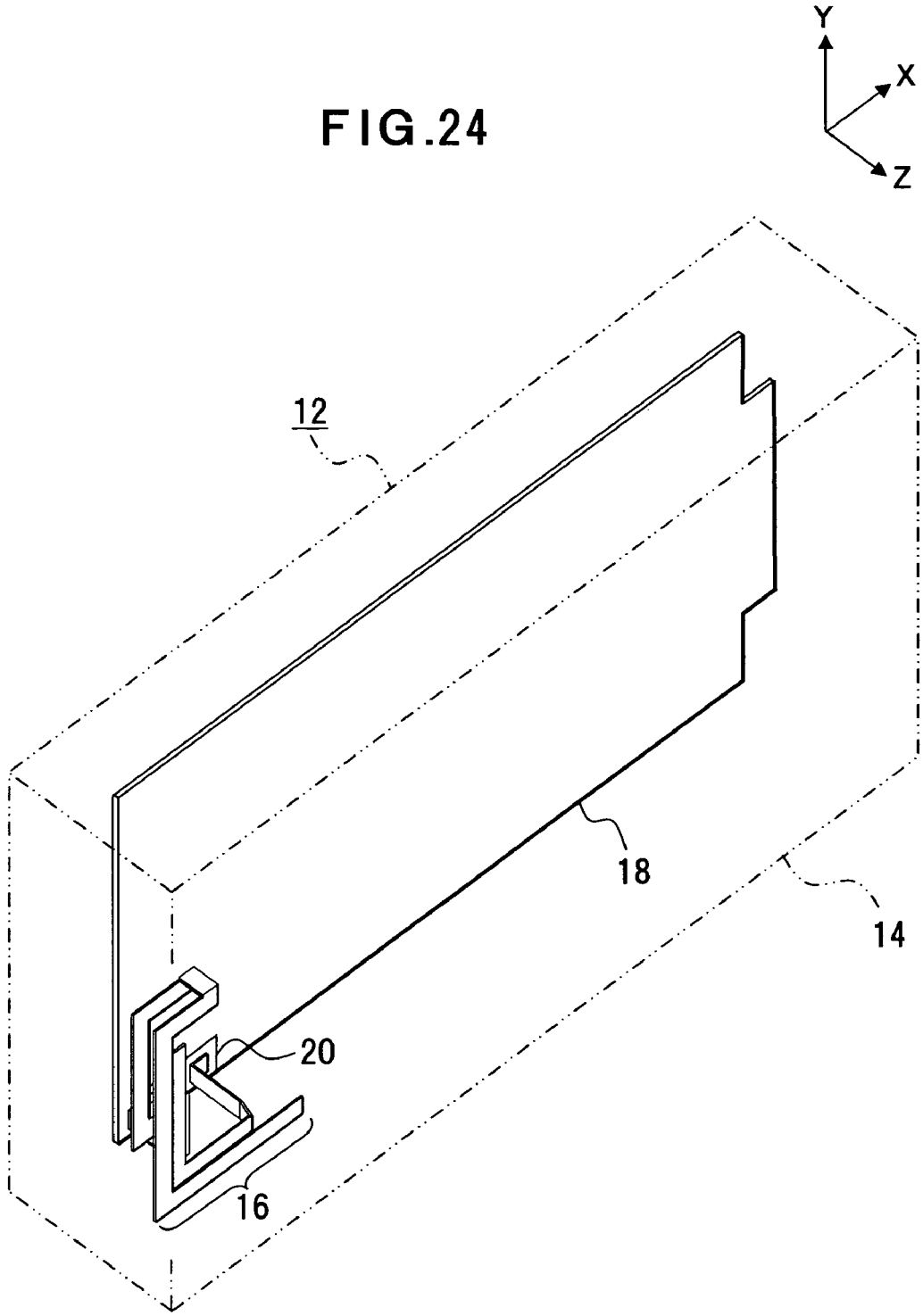
FIG. 24 shows an antenna and a cellular phone according to a third embodiment.
Figure 25:
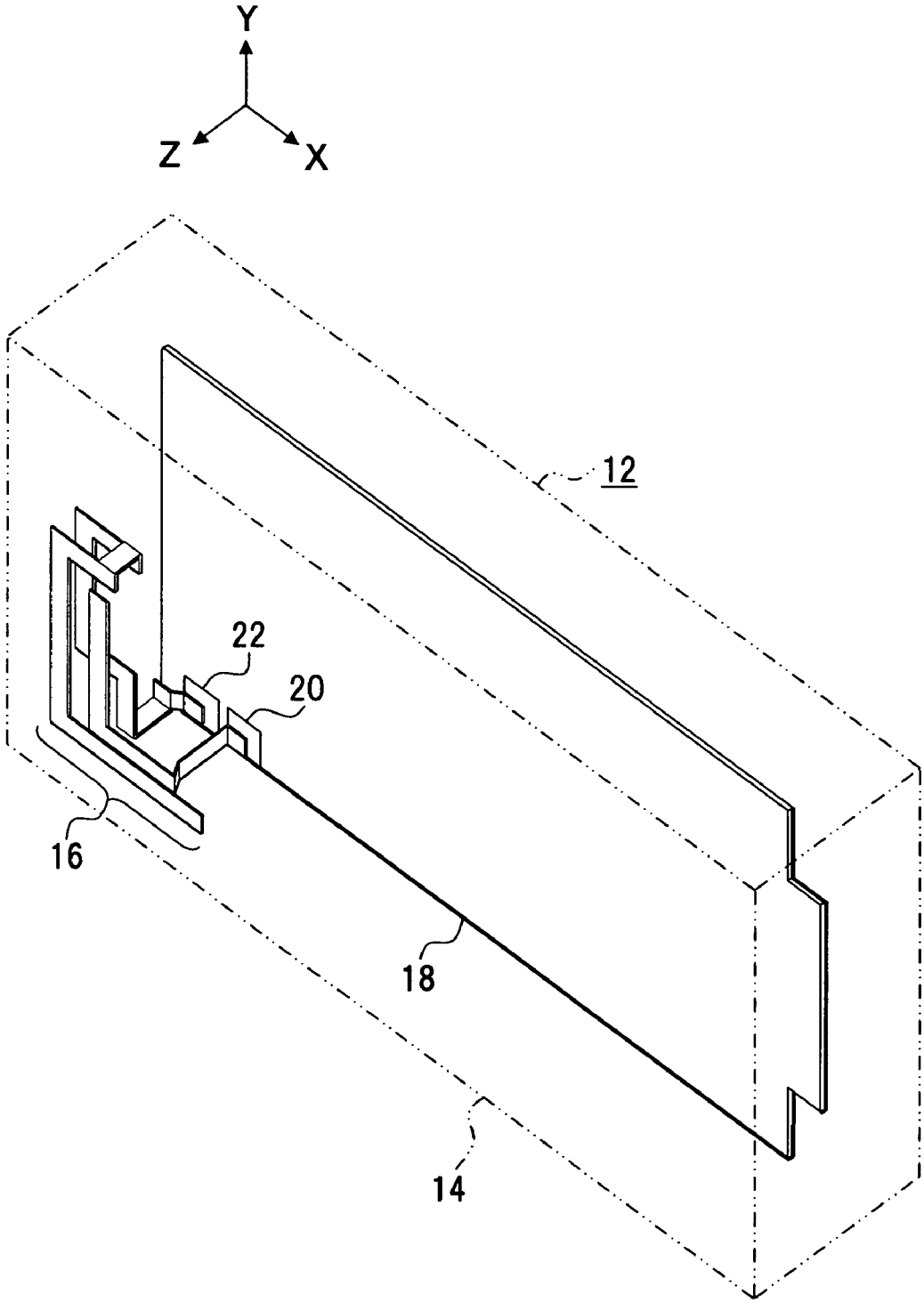
FIG. 25 shows an antenna and a cellular phone according to the third embodiment.

A third embodiment of the present invention will be described with reference to FIGS. 24 and 25. FIG. 24 is a perspective view of an outline of a cellular phone and FIG. 25 is a perspective view of the cellular phone shown in FIG. 24 when the housing is turned. In FIGS. 24 and 25, the same symbols are added to the portions same as those of FIGS. 4 and 5.

Figure 30:
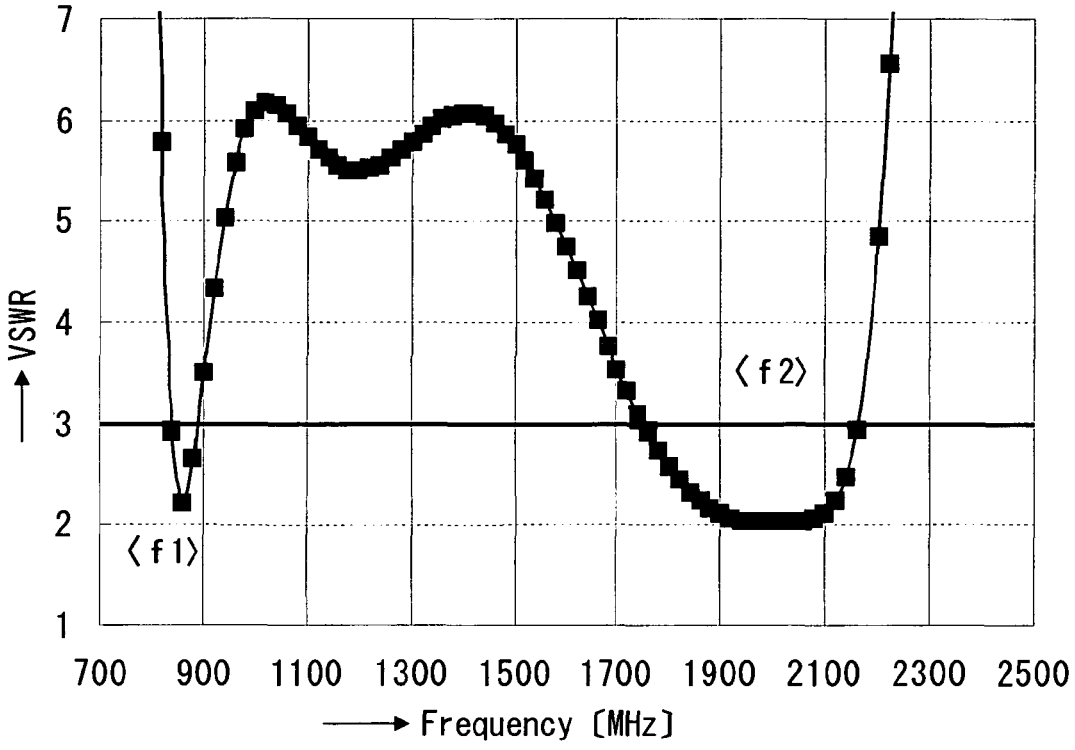
FIG. 30 shows a VSWR characteristic of the antenna according to the third embodiment.

In this embodiment, a cellular phone 12 also is an example of a wireless communication device and a housing 14 houses an antenna 16 along with a circuit substrate 18, which is provided with a feeding portion 20 for connecting the antenna 16 and a grounding portion (GND) 22. The antenna 16 can communicate at a frequency f1 and a frequency f2; at the frequency f1, the antenna 16 operates as an inverted F antenna; and at the frequency f2, the antenna 16 operates in the same way as a dipole antenna and the frequency f2 can be made broadband (FIG. 30).

In this embodiment, in the region for the same operation as a dipole antenna, since currents are concentrated on the antenna 16 and less current flows through the housing 14 and the circuit substrate 18, less effect is exerted by a body of a person holding the cellular phone 12. When the antenna 16 is installed on the surface of the circuit substrate 18, the characteristic deterioration does not occur; the antenna function is not impaired; and the antenna 16 can be completely housed within the housing 14.

Figure 26:
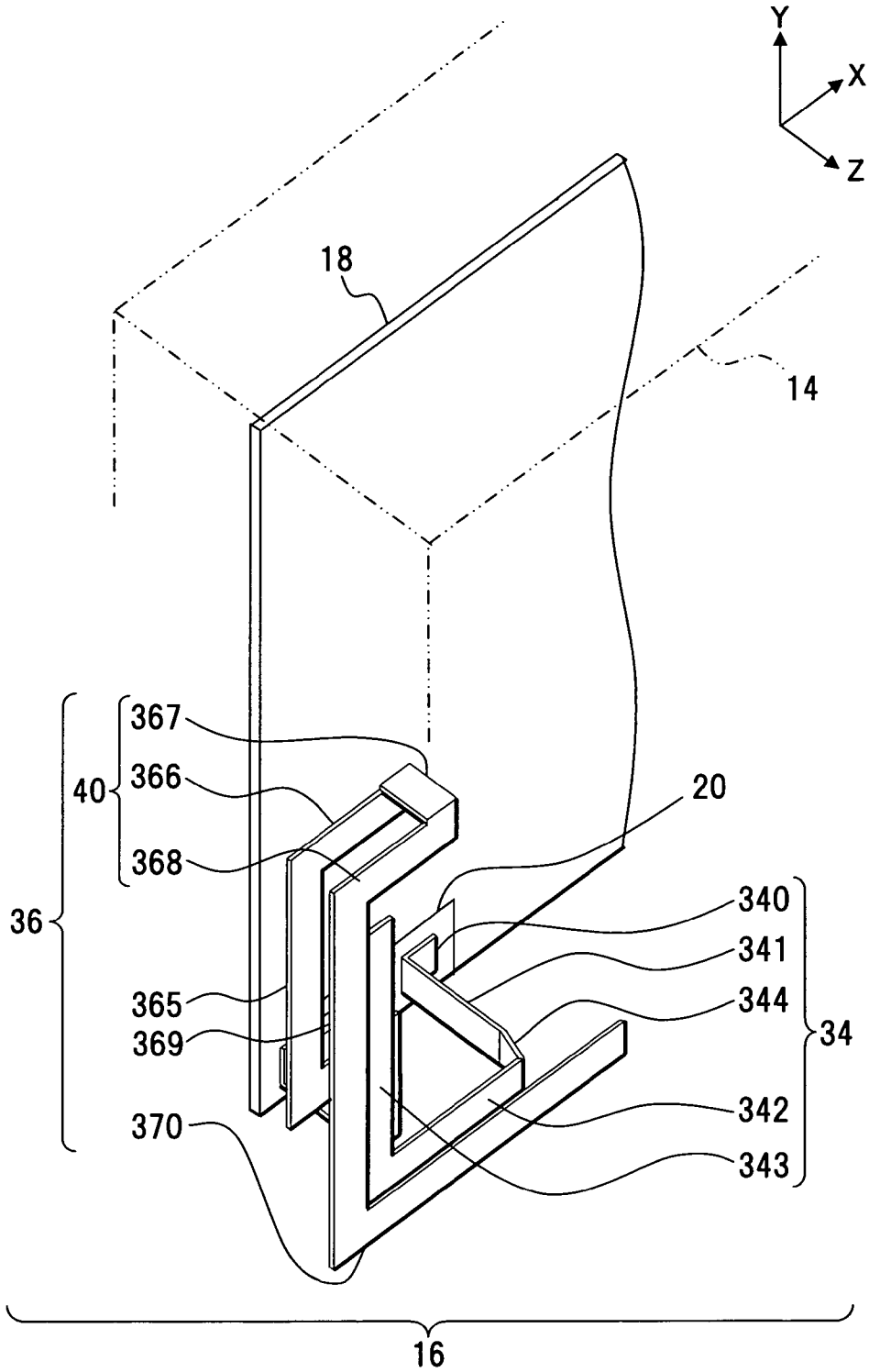
FIG. 26 shows an antenna structure.
Figure 27:
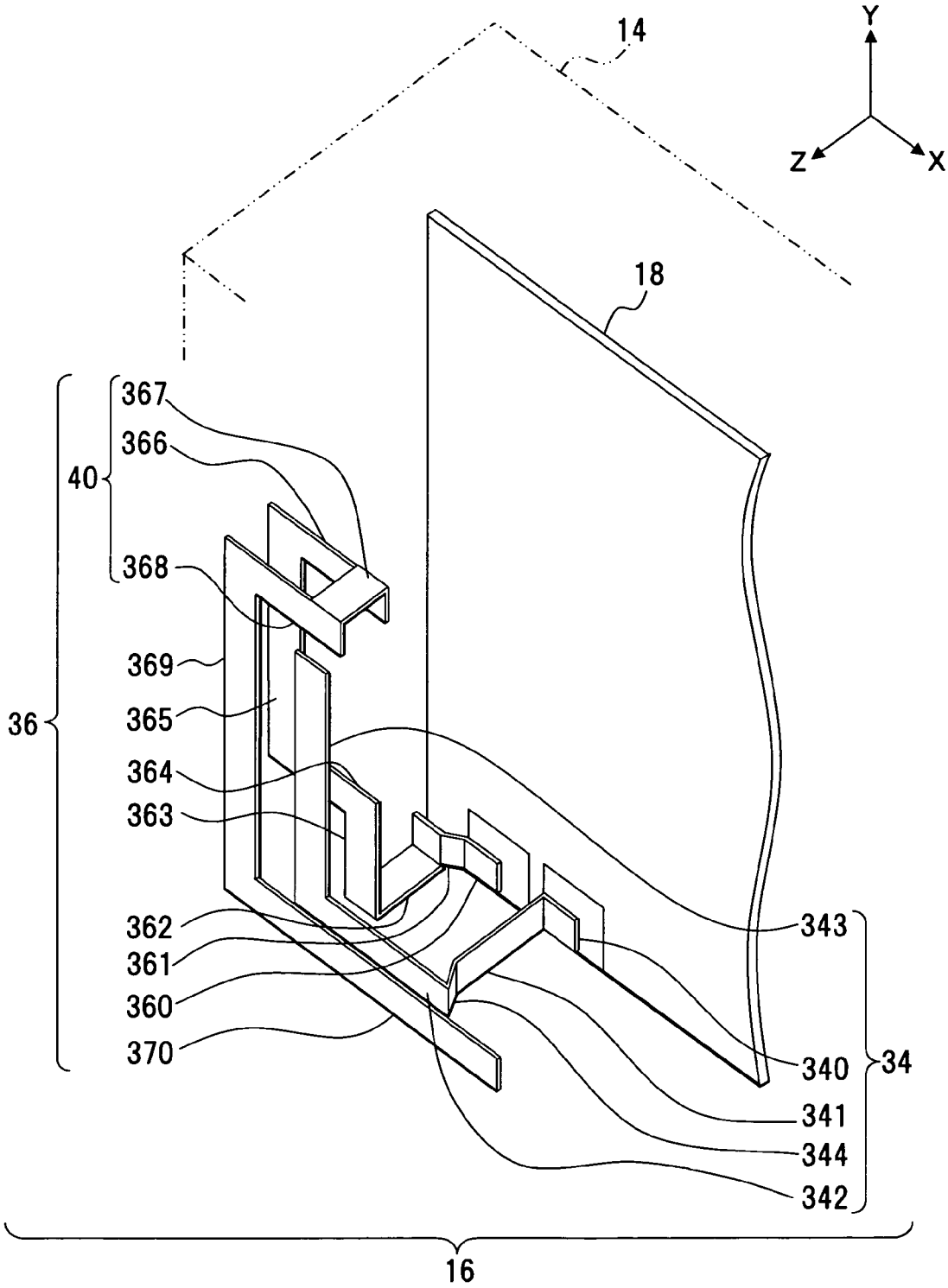
FIG. 27 shows an antenna structure.
Figure 28:
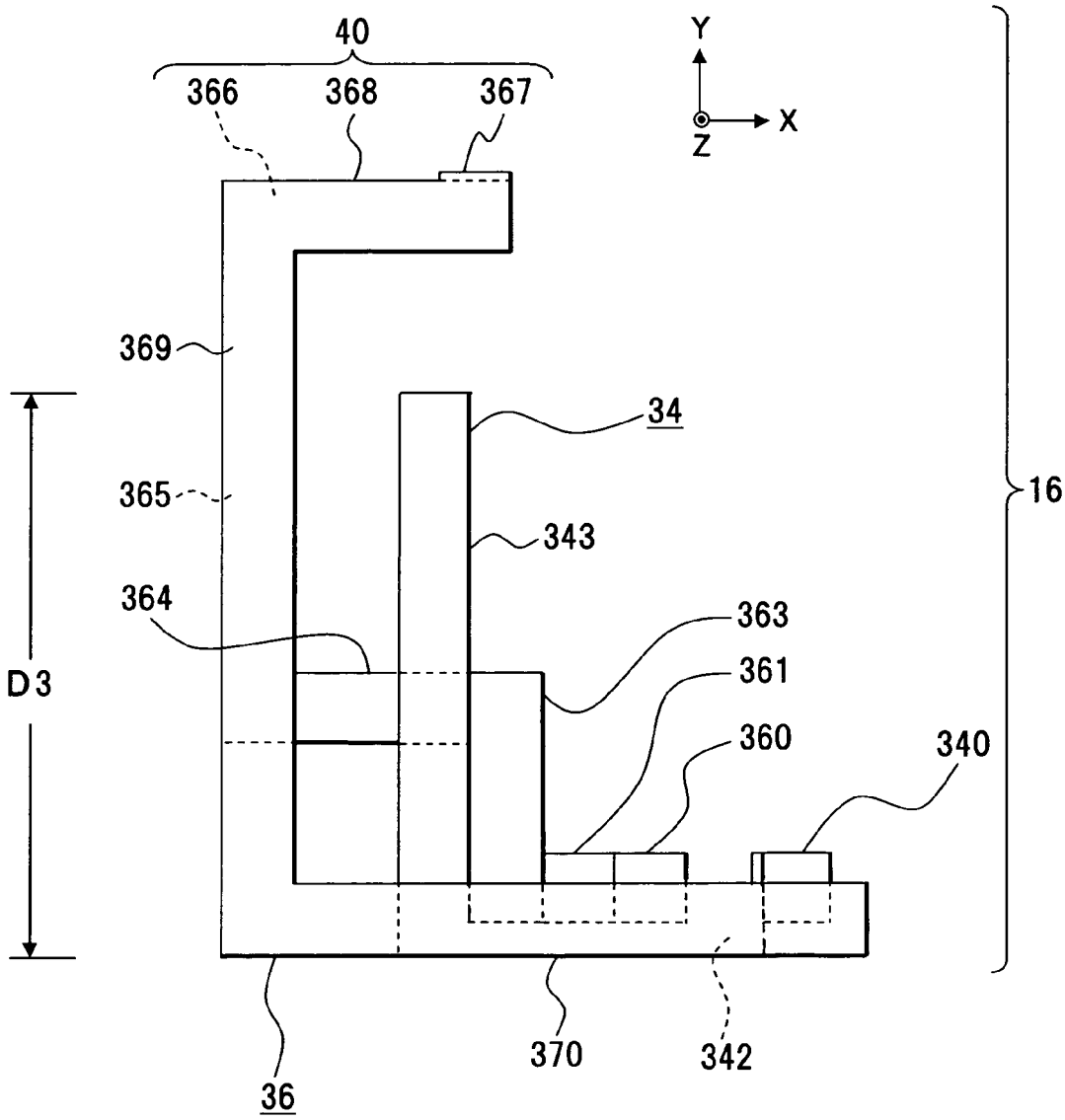
FIG. 28 shows a turn-back portion and an overlap portion of elements of the antenna.
Figure 29:
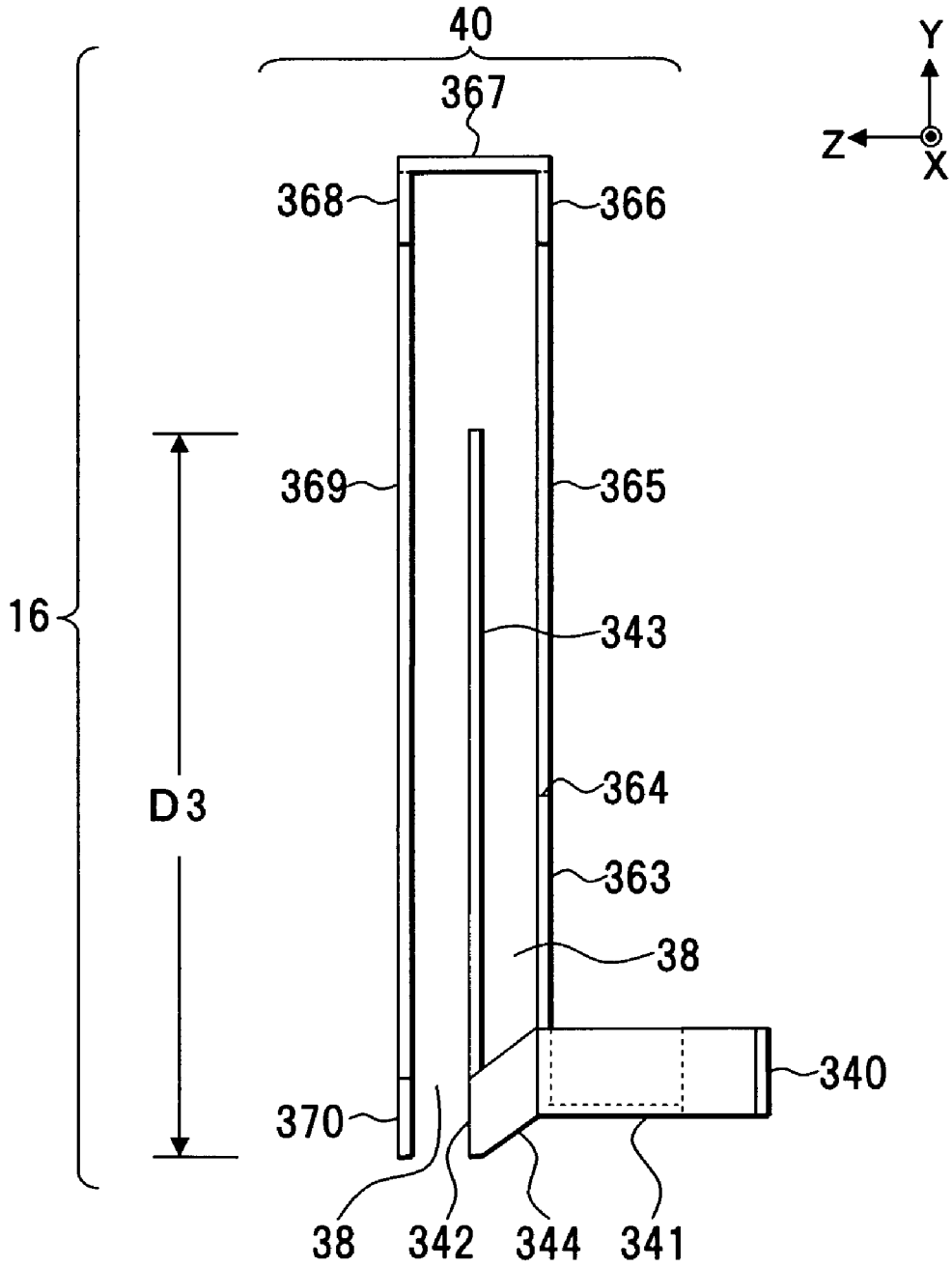
FIG. 29 shows a turn-back portion and an overlap portion of elements of the antenna.

The structure of the antenna 16 will be described with reference to FIGS. 26, 27, 28, and 29. FIG. 26 is a perspective view of the element structure of the antenna 16; FIG. 27 is a perspective view of the antenna element structure shown in FIG. 6 viewed from different angle; FIG. 28 is a plan view of the antenna portion; FIG. 29 shows an overlap element portion of elements. In FIGS. 26 to 29, the same symbols are added to the common portions or the portions same as those of FIGS. 4 and 5.

Just like the first embodiment, the antenna 16 includes first and second elements 34, 36; the element 34 is connected to the feeding portion 20; the element 36 is connected to the GND 22 of the circuit substrate 18; the both elements are not connected to each other and are coupled by the coupling feeding (indirect feeding).

For example, the element 34 is a bending unit made of a single conductor and is constituted by a feeding point 340 and element portions 341, 342, 343. To clarify the shape of the element 34 and the positional relationships of the feeding point 340 and the element portions 341, 342, 343, when the circuit substrate 18 is used as a reference plane to assume that a length direction, a width direction, and a thickness direction (penetrating direction) are an X-axis, a Y-axis, and a Z-axis, respectively, the element portion 341 is a horizontal portion rising from the circuit substrate 18 in the Z-axis direction; the element portion 342 is a horizontal portion bent from the element portion 341 via a slant portion 344 and extended in parallel with the circuit substrate 18 in the X-axis direction toward the end thereof; and the element portion 343 is a vertical portion bent from the element portion 342 and extended in parallel with the circuit substrate 18 in the Y-axis direction toward the end thereof.

The element 36 is a bending unit including a plurality of element portions as is the case with the element 34, and the element portions constituting the element 36 are a grounding portion 360 and element portions 361, 362, 363, 364, 365, 366, 367, 368, 369, and 370. The grounding portion 360 is connected to the GND 22 of the circuit substrate 18; the element portion 361 is a horizontal portion that is bent slightly from the circuit substrate 18 to be away from the circuit substrate 18 and extended in the X-axis direction; and the element portion 362 is a horizontal portion bent from the lower end of the element portion 361 to the Z-axis direction. The element portion 363 is a vertical portion bent from and disposed on the element 362 in the Y-axis direction; the element portion 364 is a horizontal portion bent from the element portion 363 in the X-axis direction; the element portion 365 is a vertical portion bent from the element portion 364 in the Y-axis direction; and the element portion 366 is a horizontal portion bent from the element portion 365 in the X-axis direction. The element portion 367 is a horizontal portion bent from the upper side of the end of the element 366 in the Z-axis direction; the element portion 368 is a horizontal portion bent from the lower side of the end of the element 367 in the X-axis direction; the element portion 369 is a vertical portion bent from the element portion 368 in the Y-axis direction; and the element portion 370 is a horizontal portion bent from the element portion 369 in the X-axis direction.

In such elements 34, 36, the element portion 341 and the element portion 362 are disposed in parallel; the element portion 342 and the element portion 370 are provided with an insulating space 38 (FIG. 29) and disposed in parallel; and the element portion 343 and the element portion 363, the element portion 365 or the element portion 369 are provided with an insulating space 38 (FIG. 29) and disposed in parallel. In this case, the element 367 bridges the element portions 366, 368 and is disposed across the element portion 343. That is, in the element 36, a turn-back portion 40 is formed with the element portions 366, 367, 368, and the element portion 343 of the element 34 is located in the space of the turn-back portion 40. That is, while the turn-back portion 30 of the first embodiment is arranged on a XY-axis plane, the turn-back portion 40 of this embodiment is projected in the Z-axis direction in three-dimensional arrangement.

When comparing the elements 34, 36, as shown in FIGS. 28 and 29, an overlap portion D3 exists in the element portions 343, 369, 365, 363, and the capacity coupling can be obtained with this overlap portion D3 to achieve the coupling feeding between the elements 34, 36.

The elements 34, 36 can be constituted by freely arranging the element portions 341 to 343, 361 to 370 and a VSRW characteristic shown in FIG. 30 is obtained from the antenna 16 composed of the elements 34, 36. In this VSRW characteristic, it is known that while the frequency f1 is obtained by the operation of the inverted F antenna and has a narrow band, the frequency f2 achieves the operation same as the dipole antenna and has a very broad band. In the dipole antenna operation, since currents are concentrated on the antenna 16, less current flows through the housing 14 and the circuit substrate 18 and less effect is exerted by a human body.

Fourth Embodiment

Figure 31:
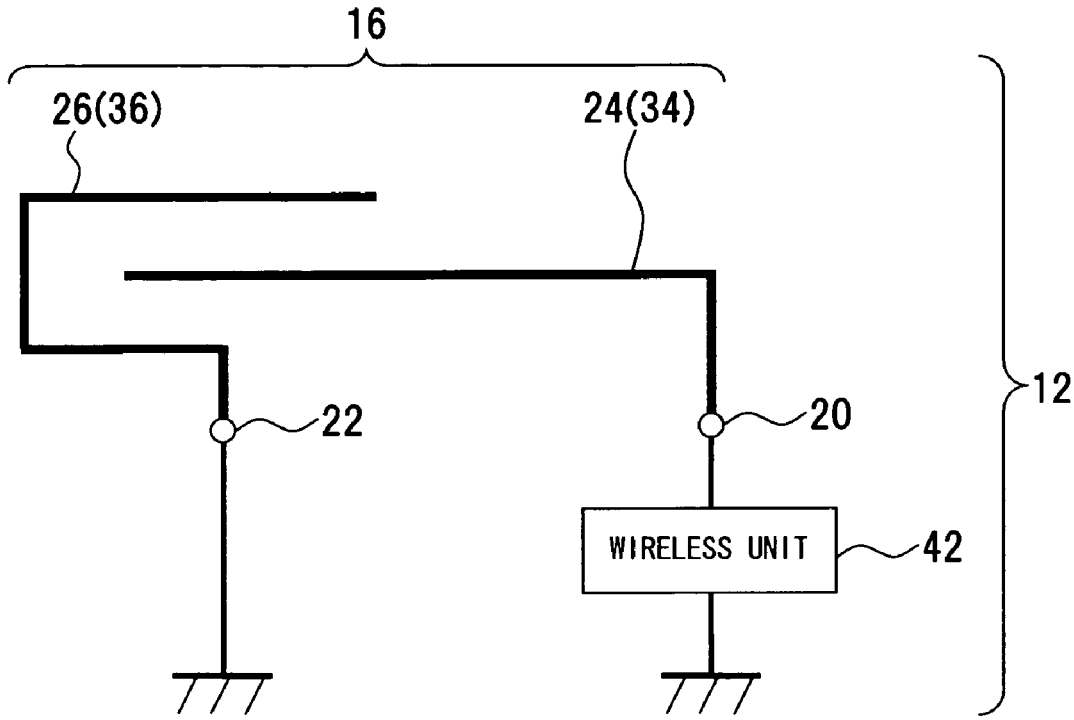
FIG. 31 shows a connection circuit of an antenna of a cellular phone according to a fourth embodiment.

A fourth embodiment of the present invention will be described with reference to FIG. 31. FIG. 31 shows a connection circuit of an antenna of a cellular phone. In FIG. 31, the same symbols are added to the portions same as those of FIGS. 4, 5, and 24.

A cellular phone 12 is an example of a wireless communication device and is equipped with the antenna 16 as described above; the element 24 (34) is connected to a wireless unit 42 through the feeding portion 20; and the element 26 (36) is grounded through the GND 22. The wireless unit 42 communicates at the frequencies f1 and f2 through the antenna 16.

According to such a configuration, as described above, the elements 24, 26 are coupled and fed with electric power, operate as an inverted F antenna at the frequency f1 and operate in the same way as a dipole antenna at the frequency f2 to perform communication.

Other Embodiments

Figure 32:
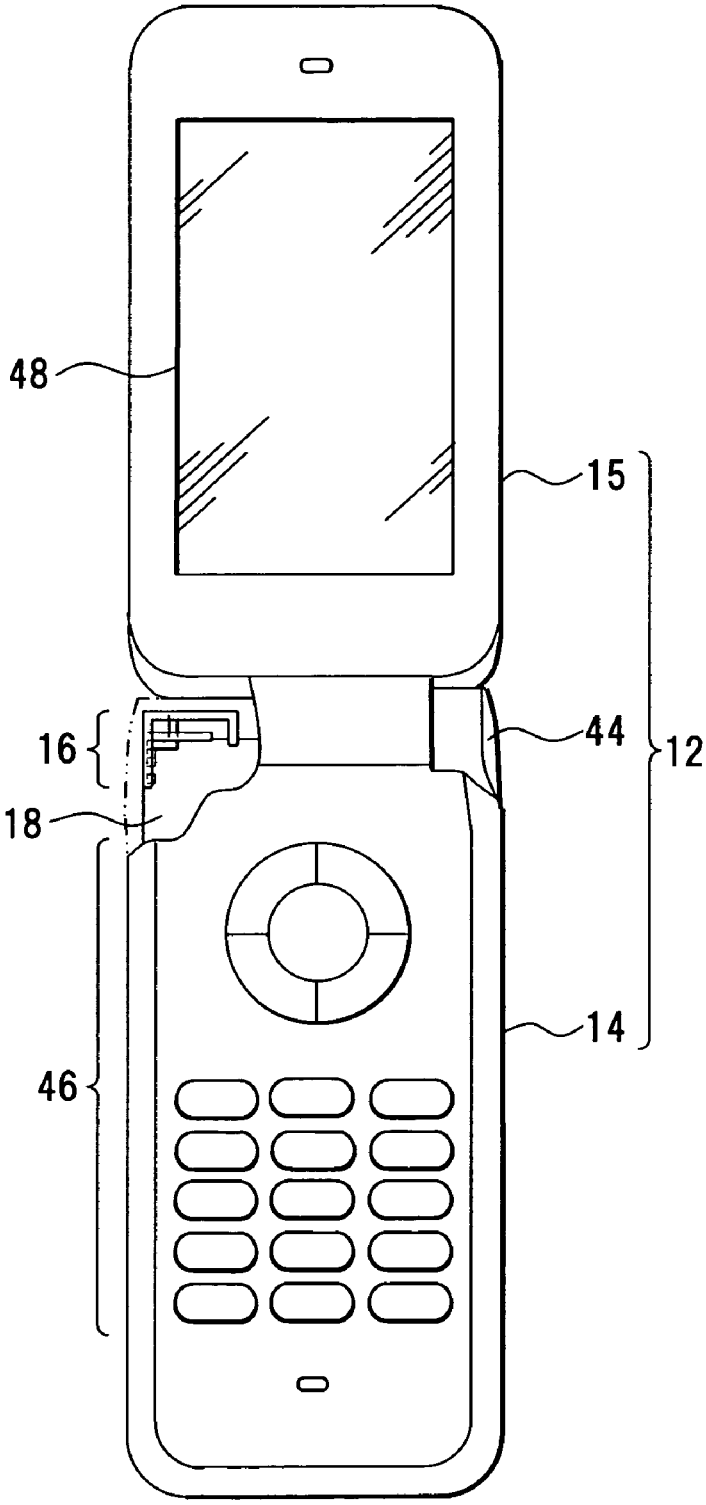
FIG. 32 shows a cellular phone equipped with the antenna.

For example, a cellular phone 12 can be configured as shown in FIG. 32, which is an example of a wireless communication device equipped with the antenna of the present invention.

This cellular phone 12 includes housing units 14, 15 and the housing units 14, 15 are coupled by a hinge portion 44 and can be folded. An operation portion 46 including numeric keys, cursor keys, etc. is disposed on the housing unit 14; the circuit substrate 18 is mounted inside the housing unit 14; and the aforementioned antenna 16 is housed within the housing unit 14. The housing unit 15 is equipped with an LCD (Liquid Crystal Display) 48, etc.

In this way, the antenna 16 can be completely housed within the housing unit 14 and the housing structure can be simplified.

Figure 33:
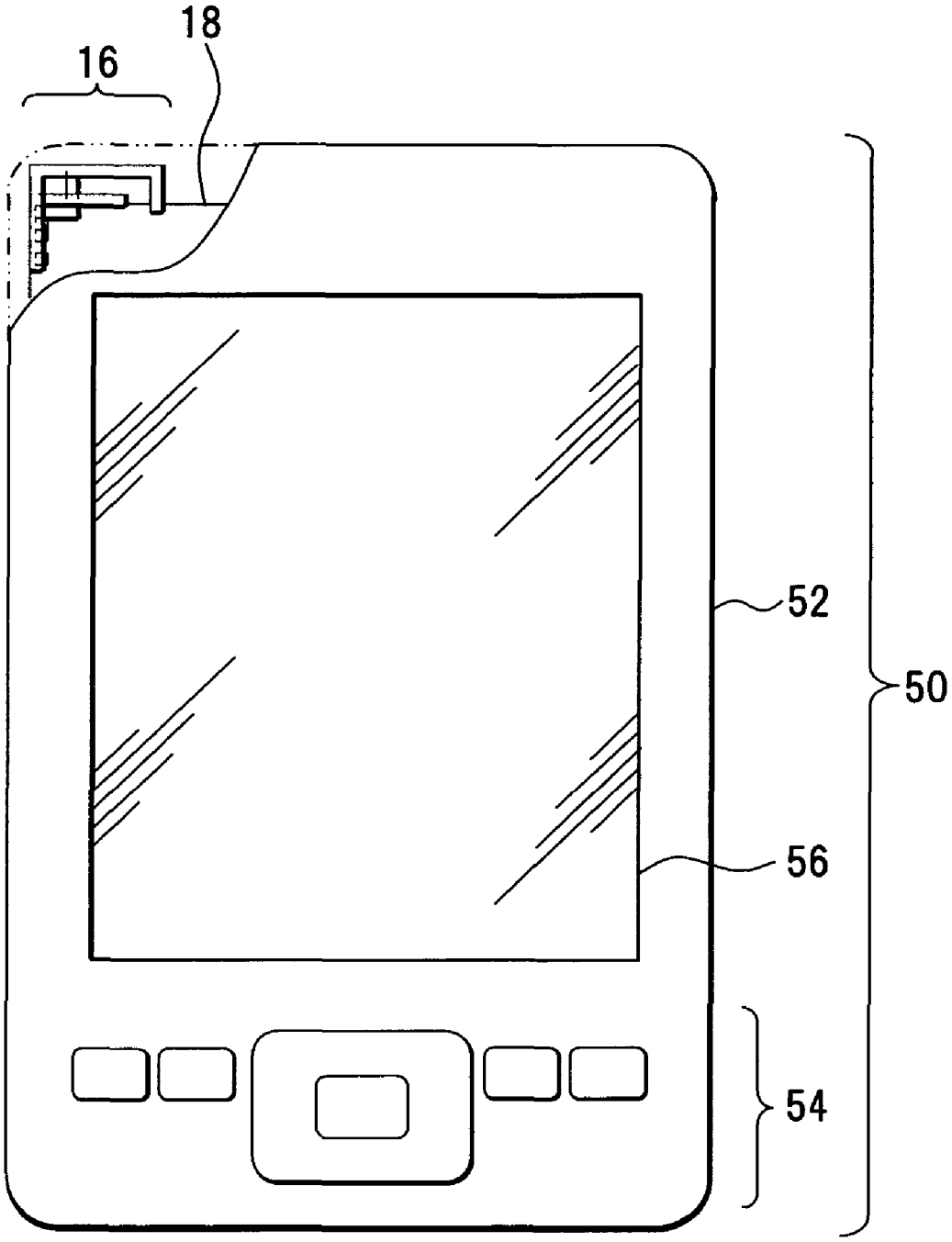
FIG. 33 shows a PDA equipped with the antenna.

For example, a personal digital assistant (PDA) 50 can be configured as shown in FIG. 33, which is an example of a wireless communication device equipped with the antenna of the present invention. The housing unit 52 of this PDA 50 is equipped with an operation unit 54, an LCD 56, etc., and the circuit substrate 18 and the antenna 16 are housed within the housing unit 52.

In this way, the antenna 16 can also be completely housed within the housing unit 52 of the PDA 50 and the housing structure can be simplified.

Figure 34:
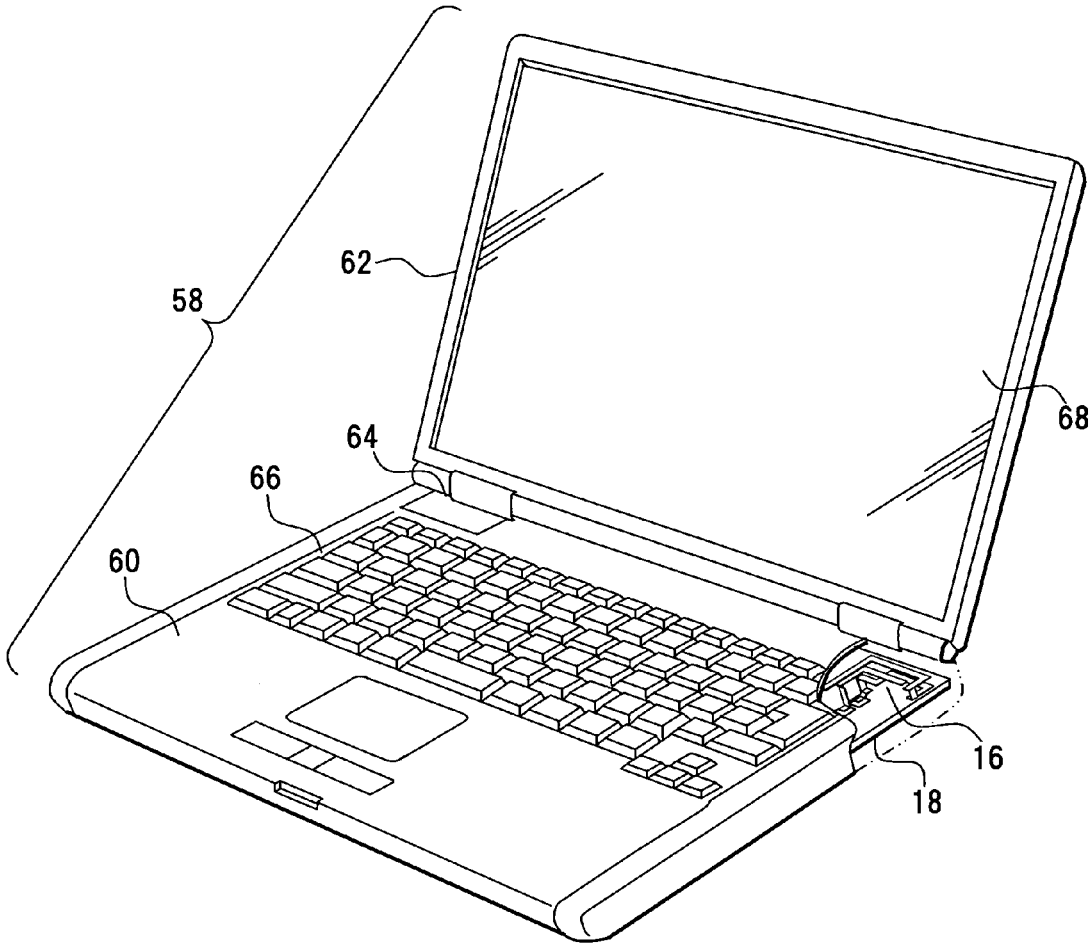
FIG. 34 shows a personal computer equipped with the antenna.

For example, a personal computer (PC) 58 provided with communication function can be configured as shown in FIG. 34, which is an example of a wireless communication device equipped with the antenna of the present invention.

This PC 58 includes housing units 60, 62 and the housing units 60, 62 are coupled by a hinge portion 64 and can be folded. An operation portion 66 including numeric keys, cursor keys, etc. is disposed on the housing unit 60; the circuit substrate 18 is mounted inside the housing unit 60; and the aforementioned antenna 16 is housed within the housing unit 60. The housing unit 62 is equipped with an LCD 68, etc.

In this way, the antenna 16 can also be completely housed within the housing unit 60 of the PC 58 and the housing structure can be simplified. The antenna 16 can also be housed within the housing unit 62.

As set forth hereinabove, the present invention includes the first and second elements and achieves the inverted F antenna at the first frequency and the dipole antenna operation at the second frequency; the present invention can achieve the second frequency having a broadband, can be completely housed within a housing, and can reduce effects of a human body; and the present invention can be used with a wireless communication device such as a cellular phone to achieve simplification of the housing structure thereof.

While the illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. An antenna adaptable to a plurality of frequencies, comprising:

a first element that is connected to a feeding point for feeding, the first element being a bending unit including a plurality of element portions; and a second element that is connected to a grounding point, the second element being arranged in proximity to the first element for coupling feeding with the first element, the second element being a bending unit including a plurality of element portions, wherein the antenna is operated at a first frequency or a second frequency higher than the first frequency, wherein the first element is set to a length resonated with the second frequency and has a resonance frequency higher than the second frequency, wherein the second element is set to a length resonated with the first frequency and has a primary resonance frequency higher than the first frequency and a high-order resonance frequency in a vicinity of the second frequency, and wherein the second element operates as a main radiating element at the first frequency, and both of the first element and the second element operate as radiating elements at the second frequency.

2. The antenna of claim 1, wherein dipole antenna operation is performed by the first element and the second element at the second frequency.

3. The antenna of claim 1, wherein the first element and the second element are arranged in three-dimension.

4. The antenna of claim 1, wherein the second element is comprised of a turn-back portion, and an overlap portion with the first element, which is disposed in the turn-back portion, adjusts the second frequency.

5. The antenna of claim 1, wherein the first element and the second element are installed within a housing of a wireless communication device.

6. A method of adjusting resonance frequency of an antenna adaptable to a plurality of frequencies, comprising:

forming a turn-back portion in a second element, made of a single conductor, by bending the second element, the second element being for coupling feeding with a first element connected to a feeding point, the first element being a bending unit including a plurality of element portions;

adjusting the first element to a length resonated with a second frequency higher than a first frequency and setting a resonance frequency higher than the second frequency;

adjusting the second element to a length resonated with the first frequency, and setting a primary resonance frequency higher than the first frequency and a high-order resonance frequency in the second frequency or the vicinity of the second frequency;

adjusting the second frequency by the turn-back portion; and adjusting the second element so as to operate as a main radiating element at the first frequency, and both the first and second elements so as to operate as radiating elements at the second frequency.

7. A wireless communication device housing an antenna adaptable to a plurality of frequencies, comprising:

a first element that is connected to a feeding point for feeding, the first element being a bending unit including a plurality of element portions; and a second element that is connected to a grounding point, the second element being arranged in proximity to the first element for coupling feeding with the first element, the second element being a bending unit including a plurality of element portions, wherein the wireless communication device is operated at a first frequency or a second frequency higher than the first frequency, wherein the first element is set to a length resonated with the second frequency and has a resonance frequency higher than the second frequency, wherein the second element is set to a length resonated with the first frequency and has a primary resonance frequency higher than the first frequency and a high-order resonance frequency in the vicinity of the second frequency, and wherein the second element operates as a main radiating element at the first frequency, and both the first and second elements operate as radiating elements at the second frequency.

8. The wireless communication device of claim 7, wherein dipole antenna operation is performed by the first element and the second element at the second frequency.

9. The wireless communication device of claim 7, wherein the first element and the second element are arranged in three-dimension.

10. The wireless communication device of claim 7, wherein the second element is comprised of a turn-back portion, and an overlap portion with the first element, which is disposed in the turn-back portion, adjusts the second frequency.

* * * * *